US006612793B2

(12) United States Patent
Coslovi et al.

(10) Patent No.: US 6,612,793 B2
(45) Date of Patent: Sep. 2, 2003

(54) RAIL ROAD CAR WITH LADING SECUREMENT STORAGE APPARATUS

(75) Inventors: Ilario A. Coslovi, Burlington (CA); Peter N. Jupp, Burlington (CA); David J. Keats, Brantford (CA)

(73) Assignee: National Steel Car Limited, Hamilton (CA)

( * ) Notice: Subject to any disclaimer, the term of this patent is extended or adjusted under 35 U.S.C. 154(b) by 0 days.

(21) Appl. No.: 09/893,368

(22) Filed: Jun. 27, 2001

(65) Prior Publication Data

US 2003/0002949 A1 Jan. 2, 2003

(30) Foreign Application Priority Data

Jun. 26, 2001 (CA) ..... 2351668

(51) Int. Cl.[7] ..... B61D 45/00; B65H 75/22

(52) U.S. Cl. ..... 410/100; 410/106; 242/395.1; 242/399; 242/401

(58) Field of Search ..... 410/12, 97, 100, 410/103, 106; 242/395, 395.1, 399, 399.2, 400, 401; 254/380, 382; 206/597; 220/1.5

(56) References Cited

U.S. PATENT DOCUMENTS 2,623,760 A * 12/1952 Fornelius ..... 410/51
3,407,753 A * 10/1968 Stafford, Jr. ..... 410/99
3,508,502 A * 4/1970 Sims ..... 410/103
3,954,226 A * 5/1976 Pickering ..... 242/395
4,311,288 A * 1/1982 Galland ..... 242/532.6
4,390,141 A * 6/1983 Webster ..... 242/404.2
4,951,575 A * 8/1990 Dominguez et al. ..... 105/406.1
5,024,567 A * 6/1991 Dominguez et al. ..... 410/100
5,251,947 A * 10/1993 Kirila et al. ..... 296/37.6
5,899,646 A * 5/1999 Tatina et al. ..... 410/100
5,975,454 A * 11/1999 Potter et al. ..... 242/395
6,068,210 A * 5/2000 Risa ..... 242/532.5
6,179,534 B1 * 1/2001 Weckter ..... 410/103
6,200,079 B1 * 3/2001 Little ..... 410/103
6,467,755 B2 * 10/2002 Reilly et al. ..... 254/223

* cited by examiner

*Primary Examiner*—D. Glenn Dayoan
*Assistant Examiner*—Paul Chenevert
(74) *Attorney, Agent, or Firm*—Hahn Loeser + Parks LLP; Stephen L. Grant

(57) ABSTRACT

A center beam car has a main deck structure extending laterally from a main center sill, and a central vertically oriented central beam structure. The center beam so formed defines bunks upon in which to carry cargo. The upper region of the web-work structure includes a top chord mounted to run between two end bulkheads. The cargo can be secured to the deck with straps or webs. When the car is empty the straps or webs can be stored within boxes that are accessible at deck level by a person of average height. The storage boxes can be along the center line of the car, between the posts of the center beam, or they can be located adjacent to the side sills. Further, the boxes can be movable to a raised position, or to a lowered, stored position. A reeling mechanism is provided to facilitate winding of the straps or webs for storage.

49 Claims, 16 Drawing Sheets

'G'
132
130
110
108
46
124
126
127
125

150
'L'
116
114
120
133
129
128
112
41

5c
100
RAISED
92
140
129
94
42,44
120
46
108
116
104
115
118
LOWERED

RAIL ROAD CAR WITH LADING SECUREMENT STORAGE APPARATUS

FIELD OF THE INVENTION

This invention relates generally to center beam rail road cars and to lading securement apparatus for those rail road cars.

BACKGROUND OF THE INVENTION

Center beam rail road cars, in cross-section, generally have a body having a flat car deck and a center beam web structure running along the longitudinal center-line of, and standing upright from, the deck. The center beam structure is carried on a pair of rail car trucks. The rack, or center beam structure, has a pair of bulkheads at either longitudinal end. The bulkheads extend transversely relative to the rolling direction of the car. The lading supporting structure of the body includes laterally extending deck sheets or bunks mounted above, and spanning the space between, the trucks.

The center beam web structure is typically in the nature of an open frame truss for carrying vertical shear and bending loads. It stands upright from the deck and runs along the longitudinal centerline of the car between the end bulkheads. This kind of webwork structure can be constructed from an array of parallel uprights and appropriate diagonal bracing. Typically, a center sill extends the length of the car, and the posts extend upwardly from the center sill. Most often, a top truss assembly is mounted on top of the vertical web and extends laterally to either side of the centerline of the car. The top truss is part of an upper beam assembly, (that is, the upper or top flange end of the center beam) and is usually manufactured as a wide flange, or wide flange-simulating truss, both to co-operate with the center sill to resist vertical bending, and also to resist transverse bending due to lateral horizontal loading of the car while travelling on a curve. The center beam thus formed is conceptually a deep girder beam whose bottom flange is the center sill, and whose top flange is the top truss (or analogous structure) of the car.

Center beam cars are commonly used to transport packaged bundles of lumber, although other loads such as pipe, steel, engineered wood products, or other goods can also be carried. The space above the decking and below the lateral wings of the top truss on each side of the vertical web of the center beam forms left and right bunks upon which bundles of wood can be loaded. The base of the bunk often includes risers that are mounted to slant inward, and the vertical web of the center beam is generally tapered from bottom to top, such that when the bundles are stacked, the overall stack leans inward toward the longitudinal centerline of the car.

Lading is most typically secured in place using straps or cables. Generally, the straps extend from a winch device mounted at deck level, upward outside the bundles, to a top fitting. The top fitting can be located at one of several intermediate heights for partially loaded cars. Most typically, the cars are fully loaded and the strap terminates at a fitting mounted to the outboard wing of the upper beam assembly. Inasmuch as the upper beam assembly is narrower than the bundles, when the strap is drawn taut by tightening the winch, it binds on the upper outer corner of the topmost bundle and exerts a force inwardly and downwardly, tending thereby to hold the stack in place tight against the center beam web.

Each bundle typically contains a number of pieces of lumber, commonly the nominal 2"×4", 2"×6", 2"×8" or other standard size. The lengths of the bundles vary, typically ranging from 8' to 24', in 2' increments. The most common bundle size is nominally 32 inches deep by 49 inches wide, although 24 inch deep bundles are also used, and 16 inch deep bundles can be used, although these latter are generally less common. A 32 inch nominal bundle may contain stacks of 21 boards, each 1½ inch thick, making 31½ inches, and may include a further 1½ inches of dunnage for a total of 33 inches. The bundles are loaded such that the longitudinal axes of the boards are parallel to the longitudinal, or rolling, axis of the car generally. The bundles are often wrapped in a plastic sheeting to provide some protection from rain and snow, and also to discourage embedment of abrasive materials such as sand, in the boards. The bundles are stacked on the car bunks with the dunnage located between the bundles such that a fork-lift can be used for loading and unloading. For bundles of kiln dried softwood lumber the loading density is typically taken as being in the range of 1600 to 2000 Lbs. per 1000 board-feet.

Existing center beam cars tend to have been made to fall within the car design envelope, or outline, of the American Association of Railroads standard AAR Plate C, and tend to have a flat main deck that runs at the level of the top of the main bolsters at either end of the car. In U.S. Pat. No. 4,951,575, of Dominguez et al., issued Aug. 28, 1990, a center beam car is shown that falls within the design envelope of plate C, and also has a depressed center deck between the car trucks.

In center beam cars having a top truss with cantilevered truss wings extending transversely outboard from the top chord, the typical method of securing the lading, namely the bundles of lumber, in place is to fasten an array of cables, or webs, to the outboard wings of the top truss, to run the cable or web outboard about the lading, and then to anchor each cable, or web at deck level using a winch device. The winches and cables (or webs) are usually spaced along the car on pitches corresponding to the longitudinal pitch between the various upright posts of the center beam, typically on about 4 ft centers. If the car is not fully laden, the cables, or webs, can typically be hooked to attachment fittings at lower heights on the center beam posts.

In some types of center beam cars, and in some types of bulkhead flat cars that do not have center beams, or center partitions, the cables or webs have one end anchored on one side of the deck, and the web or cable is thrown clear over the lading to the other side of the car, and then a winch on the other side of the car is used to tighten the cable or web in place at the given longitudinal station. In some cases a spacer, or load spreader bracket is placed between the cable and the lading at the outer top corner of the lading where the cable by itself might otherwise dig into the lading when tightened.

The present inventors prefer webs as opposed to cables, such as were formerly more commonly used. The webs tend to be made of woven nylon (t.m.) or polyester, or PVC, and can be obtained, typically in 4 inch wide bands, although other widths are available. Typically the winch device has a spindle with a gear on one end that co-operates with a pawl. The spindle has a central slot through which the web can be wrapped, and then a bar is fed into an eye at the end of the spindle, and the end of the web is spooled up until tight. The pawl discourages the gear from turning in the loosening direction. ¾ drives are also used to tighten the web. The square for the ¾ drive can also be in the spindle, near the eye.

It has been suggested that these webs can withstand significant tensile loads, possibly as much as 20,000 lbs. in tension. The webs tend to be portable, and moderately expensive to replace. As such, they are quite attractive to thieves since a web band of this nature can be put to many household, cottage, or other uses not necessarily intended by the rail car manufacturer or operator. The webs are all the more attractive for unintended purposes if they are particularly long, as is the case when the web is of sufficient length to be passed entirely about the load from one side of the car to the other. Aside from their attractiveness to thieves, the webs may also be susceptible to needless damage during loading and unloading of the railroad cars, and when stowed for an empty return passage.

When the cars are being returned empty, the straps are typically tightened directly between the center beam and the winch, and remain exposed to the weather. Also, in remaining exposed, the webs may attract the attention of opportunistic thieves in a way that they might not otherwise do if stored out of sight. It would be advantageous to have an apparatus that permits the webs to be collected in a fashion suitable for storage, such as a reel, and a storage compartment that may keep the reeled up webs out of sight during empty operation of the cars.

A flat deck center beam car, whether having inclined risers and tapered posts or a fully planar horizontal deck with vertically sided posts will typically have a main deck height of approximately 41 inches above top of rail. Yard personnel working adjacent to the car may find this to be a convenient working height, like a tall work bench. It may not be a convenient height to climb without a ladder or footstep. In such a situation it may be advantageous to have a reeling mechanism for spooling the webbing that is located near or at the side sill. As such, a person standing adjacent to the rail car may be able to operate the mechanism without ascending the deck. In this position it would be advantageous to have a reeling mechanism, and a storage mechanism that is located in, or movable to, a position clear of the deck so that it does not obstruct loading or unloading.

By contrast, for a dropped deck center beam car having a depressed central deck portion the medial deck height may be of the order of 20 to 30 inches above top of rail, and may tend to be mounted relatively easily without the need for a ladder. Further, if the end portions are raised to a height of 50 to 60 inches above top of rail, it may be easier first to ascend the medial portion of the deck, then to ascend the end portions of the deck and to work from deck level rather than working from trackside. In such a situation, a reeling mechanism and storage boxes placed in the space between the posts of the center beam may be advantageous.

SUMMARY OF THE INVENTION

In an aspect of the invention there is a center beam rail road car having a deck structure upon which lading can be supported. The deck structure is carried by spaced apart rail car trucks. A central beam structure runs along the deck structure and extends upwardly therefrom. The rail car has lading securement apparatus for restraining lading carried upon the deck structure. Lading securement storage apparatus is mounted to the deck structure. The lading securement apparatus includes at least one band of webbing for wrapping about the lading, securing equipment mounted to at least one of (a) the deck structure and (b) the central beam structure, by which to anchor the webbing to at least one of (a) the deck structure and (b) the central beam structure. The lading securement storage apparatus includes a winder mounted to the deck structure, the winder being operable to form the band into a storage configuration; an enclosure mounted to the deck structure, the enclosure having a storage space defined therein for accommodating the band. The deck structure being free of obstruction by the winder and the enclosure when lading is carried by the deck structure.

In an additional feature of that aspect of the invention the securing equipment includes at least one end attachment fitting by which to anchor an end of the band of webbing to at least one of (a) the deck structure and (b) the central beam structure. A tightening member is mounted to one of (a) the deck structure and (b) the central beam structure, the tightening member being operable to anchor another end of the band and to tighten the band about the lading. In another feature, the deck structure includes a pair of first and second spaced apart side sills and the tightening member is a winch mounted to one of the side sills. In a further additional feature, the deck structure includes a pair of first and second spaced apart side sills, and the attachment fitting is a winch mounted to one of the side sills.

In still another feature, the winding mechanism includes a first member having a socket and a removable crank member engageable with the socket. In still another additional feature, the first member is movably connected to the deck structure and is movable between a spooling position proud of the deck structure to an inoperative position shy of the deck structure. In yet another feature, the first member is pivotally attached to the deck structure and is movable between a spooling position proud of the deck structure and an inoperative position in which the deck structure is free of obstruction by the first member. In still another feature, the first member is movable to a retracted position lying within the enclosure.

In yet again another additional feature, in the operative position, the first member is located above the enclosure and the crank member is releasable from the socket once a reel is formed thereon, whereby a reel formed on the crank can fall into the enclosure when the crank is disengaged from the socket. In still another feature, the first member is rigidly fixed to the enclosure, and the enclosure is pivotally mounted to the deck structure. In a further feature, the enclosure has a lid, the deck structure defines a lower lading bunk interface above which lading is carried, and in the inoperative position of the first member, the lid lies one of (a) flush with the interface and (b) shy of the interface.

In a yet further feature, the winder includes a crank and the enclosure has a socket in which to mount the crank for winding the webbing. In a further additional feature, the enclosure is movably mounted to the deck structure. In another feature, the car has lading bunk envelopes defined above the deck structure and to either side of the central beam structure. The winder includes a crank. The enclosure has a pair of opposed walls having apertures formed therein to define a socket for receiving the crank in a position for winding the webbing and the enclosure is pivotally mounted to the deck structure, the enclosure being movable to a stored position clear of the lading bunk envelopes.

In another aspect of the invention there is a rail road car having a deck structure for supporting lading, the deck structure being supported on railcar trucks for rolling motion along railroad tracks. Lading securement apparatus is connected to the deck structure, the lading securement apparatus including at least one web band for wrapping about the lading and at least one tightening mechanism operable to draw the band tight about the lading to restrain the lading relative to the deck structure. A lading securement storage apparatus is mounted to the deck structure, the lading securement storage apparatus including an enclosure mounted to the deck structure, the enclosure having an opening defined therein for admitting the web band to be placed within the enclosure. The enclosure is movable to a first position in which the opening is exposed to permit the web band to be introduced therein. The enclosure being movable to a second position in which the opening is obstructed.

In an additional feature of that aspect of the invention, the enclosure is mounted at a hinge, and is pivotable about the hinge between the first and second positions. In another feature, the storage apparatus includes a winding apparatus mountable therewith, the winding apparatus being operable to coil the web band. In still another feature, the winding apparatus includes a crank. In yet another feature, the crank includes a radial slot through which the web band can be threaded. In still another feature, the enclosure includes a socket, and the lading securement storage apparatus includes a crank mountable within the socket for coiling the web band.

In another aspect of the invention there is a center beam rail road car having a deck structure carried upon spaced apart rail car trucks and a central beam assembly running along the deck structure and standing upwardly thereof. Bunks for carrying lading are defined to either side of the central beam structure above the deck structure. The central beam structure having an array of posts standing upwardly of the deck structure. There are lading securement apparatus for securing lading in the bunks, the lading securement apparatus including web bands for wrapping about the lading. There is at least one storage enclosure mounted between a pair of the posts. At least one winder mechanism is mounted between a pair of the posts for reeling the bands. A storage enclosure for accommodating wound web bands is mounted between a pair of the posts.

In an additional feature of that aspect of the invention, the winder includes a crank having a shaft about which to wind the web bands, the shaft having an axis oriented longitudinally relative to the rail road car. In another additional feature, the storage enclosure has a movable lid controlling access thereto, and the movable lid has a fitting by which the lid can be secured in place with a lock.

BRIEF DESCRIPTION OF THE DRAWINGS

These and other aspects and features of the invention may be better understood with the aid of the accompanying illustrative drawings.

FIG. 12*b* shows a section view '12*b*—12*b*' of the storage box of FIG. 12*a.

DETAILED DESCRIPTION OF THE INVENTION

Figure 1A:
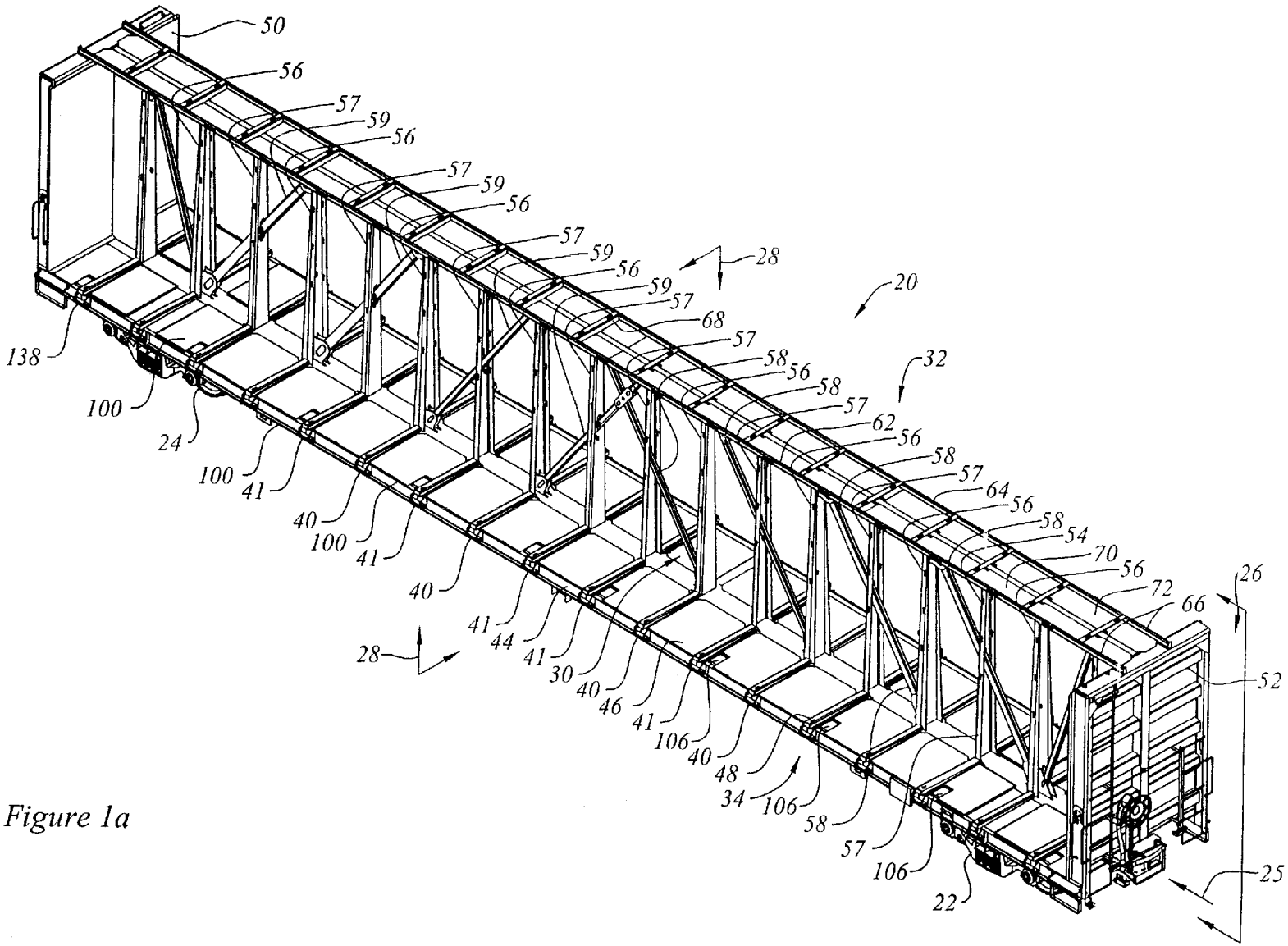
FIG. 1*a* shows an isometric, general arrangement view of a center beam rail road car having a straight-through main deck, according to the present invention.

The description which follows, and the embodiments described therein, are provided by way of illustration of an example, or examples of particular embodiments of the principles of the present invention. These examples are provided for the purposes of explanation, and not of limitation, of those principles and of the invention. In the description which follows, like parts are marked throughout the specification and the drawings with the same respective reference numerals. The drawings are not necessarily to scale and in some instances proportions may have been exaggerated in order more clearly to depict certain features of the invention.

In terms of general orientation and directional nomenclature, for each of the rail road cars described herein, the longitudinal direction is defined as being coincident with the rolling direction of the car, or car unit, when located on tangent (that is, straight) track. In the case of a car having a center sill, whether a through center sill or stub sill, the longitudinal direction is parallel to the center sill, and parallel to the side sills, if any. Unless otherwise noted, vertical, or upward and downward, are terms that use top of rail TOR as a datum. The term lateral, or laterally outboard, refers to a distance or orientation extending cross-wise relative to the longitudinal centerline of the railroad car, or car unit, indicated as CL-Rail Car. The term "longitudinally inboard", or "longitudinally outboard" is a distance or orientation relative to a mid-span lateral section of the car, or car unit.

A center beam railroad car is indicated in FIG. 1*a* generally as 20. It is carried on railroad car trucks 22 and 24 in a rolling direction along rails in the generally understood manner of railcars. Car 20 has a longitudinal centerline 25 lying in a longitudinal plane of symmetry, indicated generally as 26 which intersects the kingpin connections of trucks 22 and 24. It will be appreciated that aside from fittings such as hand grabs, ladders, brake fittings, and couplers, the structure of car 20 is symmetrical about the longitudinal plane of symmetry, and also about a transverse plane of symmetry 28 at the mid-length station of the car. In that light, a structural description of one half of the car will serve to describe the other half as well.

Figure 2:
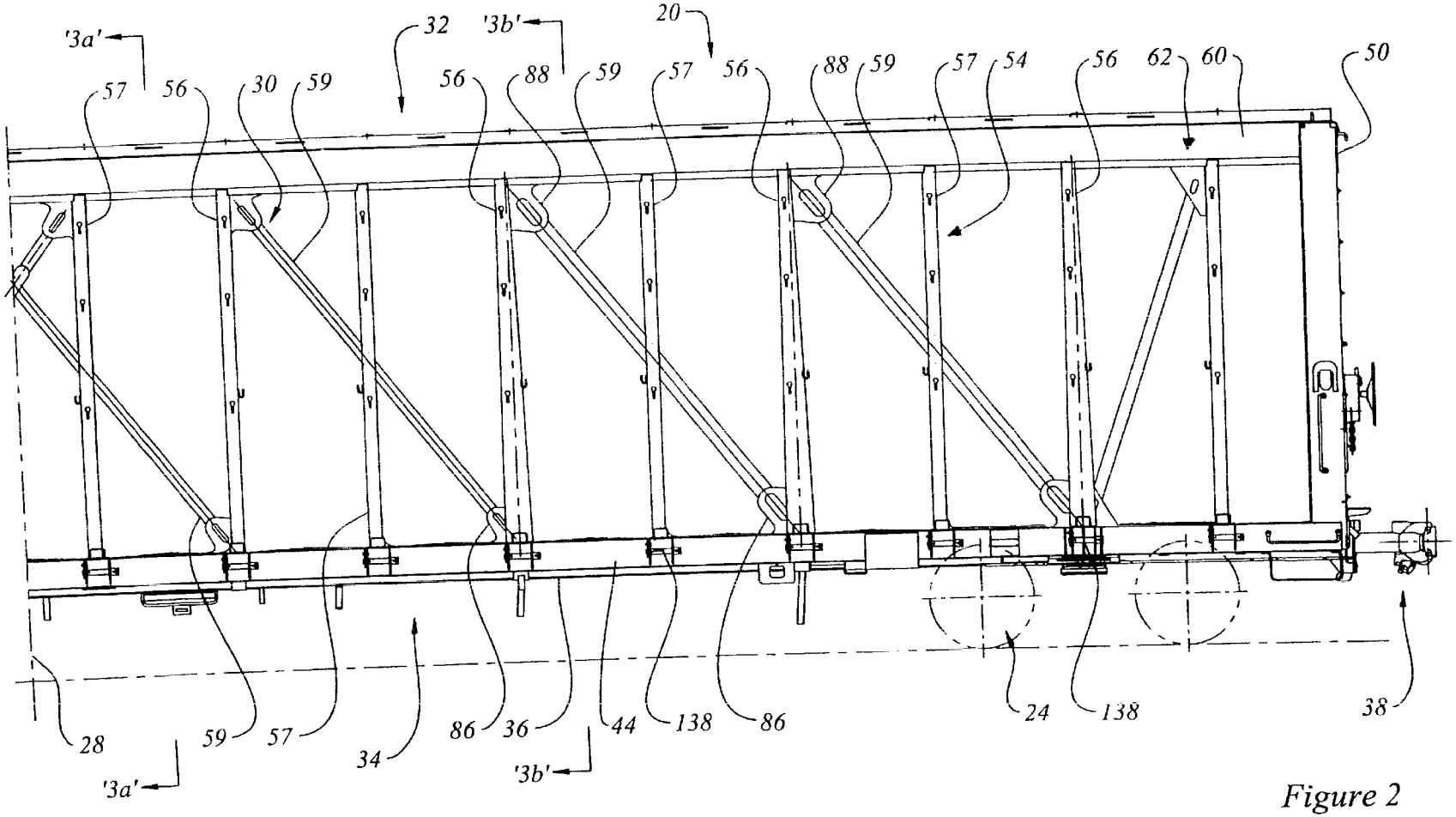
FIG. 2 shows a side view of one half of the center beam car of FIG. 1*a;*

The structure of a center beam car, such as in FIGS. 1*a* and 2 as 20, is analogous to a deep beam having a tall central structure to approximate the web of a beam, or a web-like structure or truss assembly, a wide flange at the bottom, and a wide flange at the top. In the case of railroad car 20, the central web-work assembly is indicated generally as 30 and runs in the longitudinal direction (that is, the rolling direction of the car), the top flange function is served by a top truss assembly 32, and the lower flange function is performed by a lower flange assembly in the nature of a lateral support structure 34, upon which cargo can be placed, and that extends laterally outward to either side of the car center line 25.

Figure 3B:
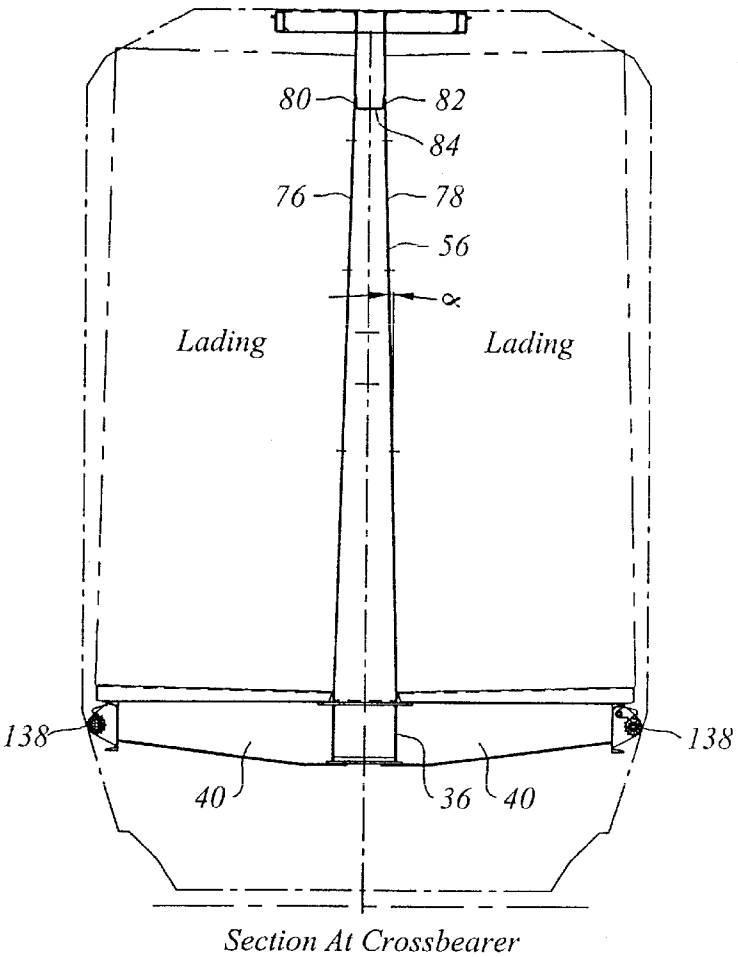
FIG. 3*b* shows section '3*b*—3*b*' of the car of FIG. 2 facing a cross-bearer.
Figure 3A:
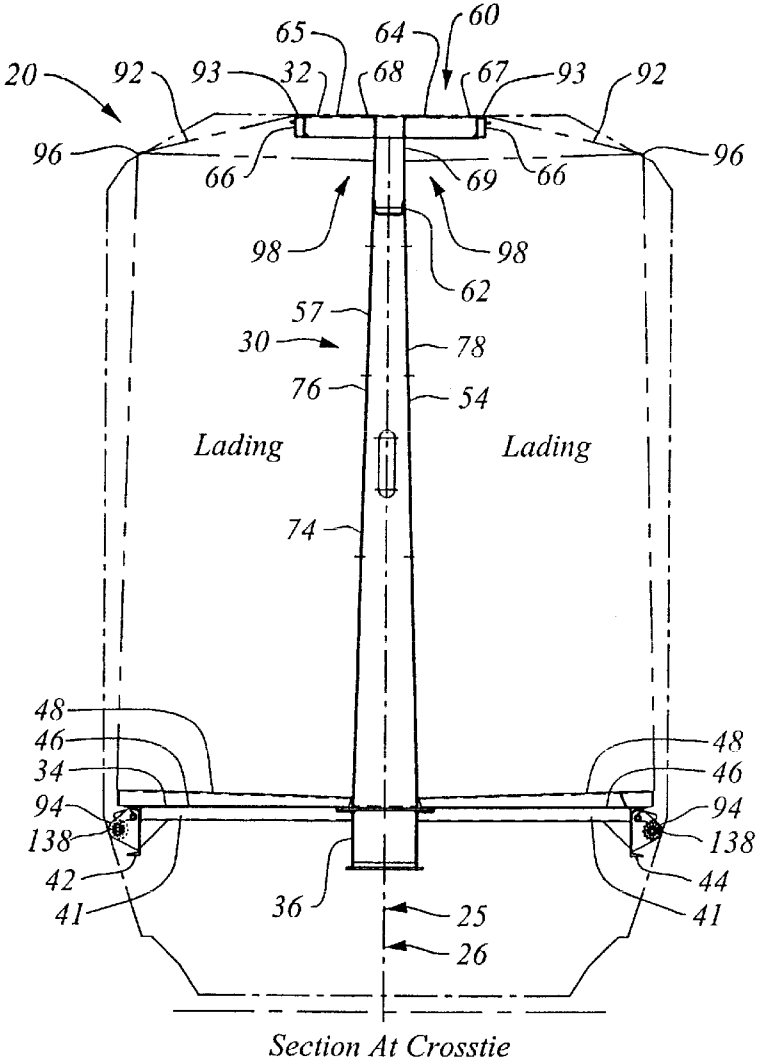
FIG. 3*a* shows section '3*a*—3*a*' of the car of FIG. 2 facing a cross-tie.

In detail, as shown in FIGS. 3*a* and 3*b*, car 20 has at its lowest extremity main center sill 36, in the nature of a fabricated steel box beam that extends longitudinally along the centerline of car 20 throughout its length, having couplers 38 (FIG. 2) mounted at either end. Cross bearers 40 extend outwardly from center sill 36 to terminate at a pair of longitudinal left and right hand side sills 42, 44 that also run the length of the car. In the car illustrated, cross members in the nature of cross-bearers 40 and cross-ties 41 extend laterally outward from center sill 36 on approximately 4 ft centers. Decking 46 is mounted to extend between cross-bearers 40, and cross-ties 41 providing a shear connection between adjacent cross members when side loads are imposed on the car. Decking 46 has deck sheeting lying flush, or roughly flush, with the top flange of main center sill 36, roughly 41 inches above top of rail. Tapered risers 48 are mounted above the cross members to form the base, or lower, upwardly facing, lading interface of a bunk for carrying loads, the upper surfaces of risers 48 lying substantially in a common plane. That is, although the deck is considered to be conceptually planar, there is a longitudinal camber of the deck structure generally, but for which the upper surfaces of risers 48 lie in a common plane. When car 20 is fully loaded, the deck structure will tend to deflect toward a true planar condition. Risers 48 are tapered so that loads stacked thereupon will tend to lean inwardly toward the center-line of car 20. The combined structure of center sill 36, cross-bearers 40, cross-ties 41, and side sills 42, 44 and decking 46 provides a wide, lower beam or lower flange assembly extending laterally outward from the longitudinal centerline of car 20.

At either end of car 20 there are vertically upstanding fore and aft end bulkheads 50 and 52 which extend from side to side, perpendicular to the central longitudinal plane 26 of car 20. Running the full length of car 20 between end bulkheads 50 and 52 is an array 54 of upright posts 56, 57. Array 54 is reinforced by diagonal braces 58, 59. As also shown in FIG. 3*a,* array 54 of posts 56 (and 57) is surmounted by an upper beam assembly 60 and deep beam top chord assembly 62. An open framework top truss 64 is mounted above, and connected to deep beam top chord assembly 62. Truss 64 has lateral wings 65 and 67 that are mounted to extend outboard from the central plane of car 20 in a cantilevered manner. Truss 64 has longitudinal stringers 66, and cross members 68.

Each of posts 56 has a central web 74 that lies in a vertical plane perpendicular to the plane 26 of car 20. Web 74 is tapered from a wide bottom adjacent main center sill 36 to a narrow top. The wide bottom portion is about 13½ inches wide, and at the top portion the inward taper is such as to yield a 6 inch width of section at the junction of top chord assembly 62 and top truss 64. At the outboard extremities of web 74 there are left and right hand flanges 76 and 78 that each lie in a longitudinal plane inclined at an angle $\alpha$ defined (from the vertical) by the slope of the taper of web 74. In the embodiment of FIG. 1*a,* $\alpha$ (shown in FIG. 3*b*) is roughly 1.45°. At the top of each post 56, 57 web 74 has been trimmed back to a pair of tabs 80, 82 at the ends of flanges 76, 78. This yields a seat, socket, relief, or rebate in the nature of a generally U-shaped notch or slot 84 into which top chord assembly 62 can seat.

A horizontal cross-section of post 56 may generally have an H-shape, with web 74 extending laterally between flanges 76 and 78. Post 57, by contrast, although tapered in a similar manner to post 56, has a horizontal cross-section of a U-shaped channel, with its web being the back of the U, and the flanges being a pair of legs extending away from the back. Each diagonal member 58 (or 59) has a first end rooted at a lower lug 86 welded at the juncture of the base of one of the posts 56 (or 57) and main center sill 36, and a second diagonal end rooted in an upper lug 88 at the juncture of another adjacent post 56 (or 57) and top chord assembly 62. Midway along its length, diagonal beam 58 (or 59) passes through a post 57 intermediate the posts 56 (or 57) to which diagonal 58 (or 59) is mounted. It is intended that the respective flanges of the various posts 56 and 57 lie in the same planes on either side of the central plane 26 of car 20 to present an aligned set of bearing surfaces against which lading can be placed. The incline of flanges 76 and 78 is such that they lie at roughly a right angle to the inward taper of risers 48 so that generally square or rectangular bundles can be stacked neatly in the clearance opening of the bunk defined between the underside of the top truss 64 and risers 48. In the embodiment of FIGS. 2 and 3*a*, upper beam assembly 60 can be defined as the combination of top chord assembly 62 and top truss 64. It has a cross section in the shape, generally, of a 'T', with the cross-bar of the T being defined by wings 65 and 67 of top truss 64, and the stem 69 of the 'T' being defined by top chord assembly 62, described more fully below.

Webbing bands, identified as straps 92, (FIG. 3*a*) are provided to attach to the outboard, distal extremities of wings 65 and 67 of top truss 64, to be wrapped outboard of the load as indicated in FIG. 3*a,* and to be tightened by a come-along, a winch, a pawl-and-ratchet type of mechanism, indicated generally as 94, or similar tightening device mounted to the respective side sill 42 or 44. An operator turns mechanism 94 with the aid of an extension bar or handle (not shown) or other device such as a ¾ inch ratchet drive. When tightened, straps 92 bear against the outboard, upper corners of bundles indicated as 96, tending to force their inboard, upper regions, indicated generally as 98, most tightly against the upright car structure that extends parallel to plane of symmetry 26, namely array 54 and the outer shank, or skirt of stem 69 of upper beam assembly 60.

Straps 92 are preferably web bands made of a woven synthetic fibre, such as NYLON or polyester or PVC, with a fastening attachment anchor fitting at one end. The web bands may be typically 4" wide. The anchor fitting can be a hook, or ring, or loop to which the web material itself is sewn, such as by folding an end over a loop or bar, and then sewing the band back on itself. It the embodiment of FIG. 1*a*, for example, the anchor fitting (FIG. 3*a*) is a loop, identified as item 93, that mates with a fitting in the nature of a catch, or hook, located alternatively on the wing extremities when the car is fully loaded, or on the vertical posts at intermediate heights corresponding to lower loading heights of bundles. In cars employing steel cables rather than web bands, item 93 could be a short length of chain mounted to the end of the cable, the links of the chain being engageable with a notched fitting on the top truss wings.

When the car is unloaded, as shown in FIG. 1*a,* straps 92 can have their far ends engaged in one of the intermediate notches mounted to the posts. In this position the other end of the strap is fed through the slot, or eye, in the shaft of winch mechanism 94, and wound until tight. The car can then be returned empty with straps 92 secured in this position. However, it is preferable to remove the band (i.e., strap 92) from winch mechanism 94, to reel it up, and to store it in a coil in a storage box. To that end car 20 has a lading securement storage apparatus, indicated generally as 100.

Apparatus 100 includes a reeling mechanism 102 (FIG. 4*a*), described in more detail below, and a storage mechanism 104. In the embodiment illustrated in FIGS. 1 to 3*b,* the deck structure has rectangular reliefs 106 cut in the deck sheets (i.e., decking 46) adjacent to the junction of successive cross ties 41 with the respective side sills 42, 44. It is advantageous for there to be a number of reliefs corresponding to the number of straps 92, to be stored. These reliefs provide access to, and accommodate, a movable storage enclosure having the form of a generally rectangular box, 108.

Box 108 has a thickness, or small dimension 'L' corresponding to the width of the web bands, although somewhat wider, such as about 7" to allow for moderately uneven winding of a narrower reel, such as a reel formed of a 4 inch web, and to allow for easier removal by hand. Seen in the longitudinal direction looking along the side sill, as in FIG. 4*c,* box 108 has a height 'H' and a width 'W' of comparable size, the width being larger than the height, and being suited to yield a box of height and depth for accommodating the wound web band. Box 108 has a top panel, identified as top wall 110, a pair of left and right parallel, planar side panels identified as walls 112, 114 that are welded to depend from the long side margins of top panel 110; and a bent backing panel formed into a back portion identified as back wall 116, and a bottom portion identified as bottom wall 118. It may be noted that side walls 112, 114 each have a diagonal nip, or chamfer 115, at their lower inner corner (as seen in the raised position), this chamfer leaving a gap at the corner and thus providing a drain hole to discourage accumulation of water in box 108.

As can be seen, top wall 110, back wall 116 and bottom wall 118 are welded about three sides or margins of the periphery of side walls 112, 114. The fourth side, or portion, of the periphery of side walls 112, 114 is left open, except for a lip 120 formed upwardly at the distal end of bottom wall 118. The opening defined between the fourth, unboxed portion of the periphery of side walls 112, 114, lip 120, and the distal edge, or margin of top wall 110 is of a size to receive a reeled web band roughly 9 inches in diameter.

Figures 5A, 5B, 5C:
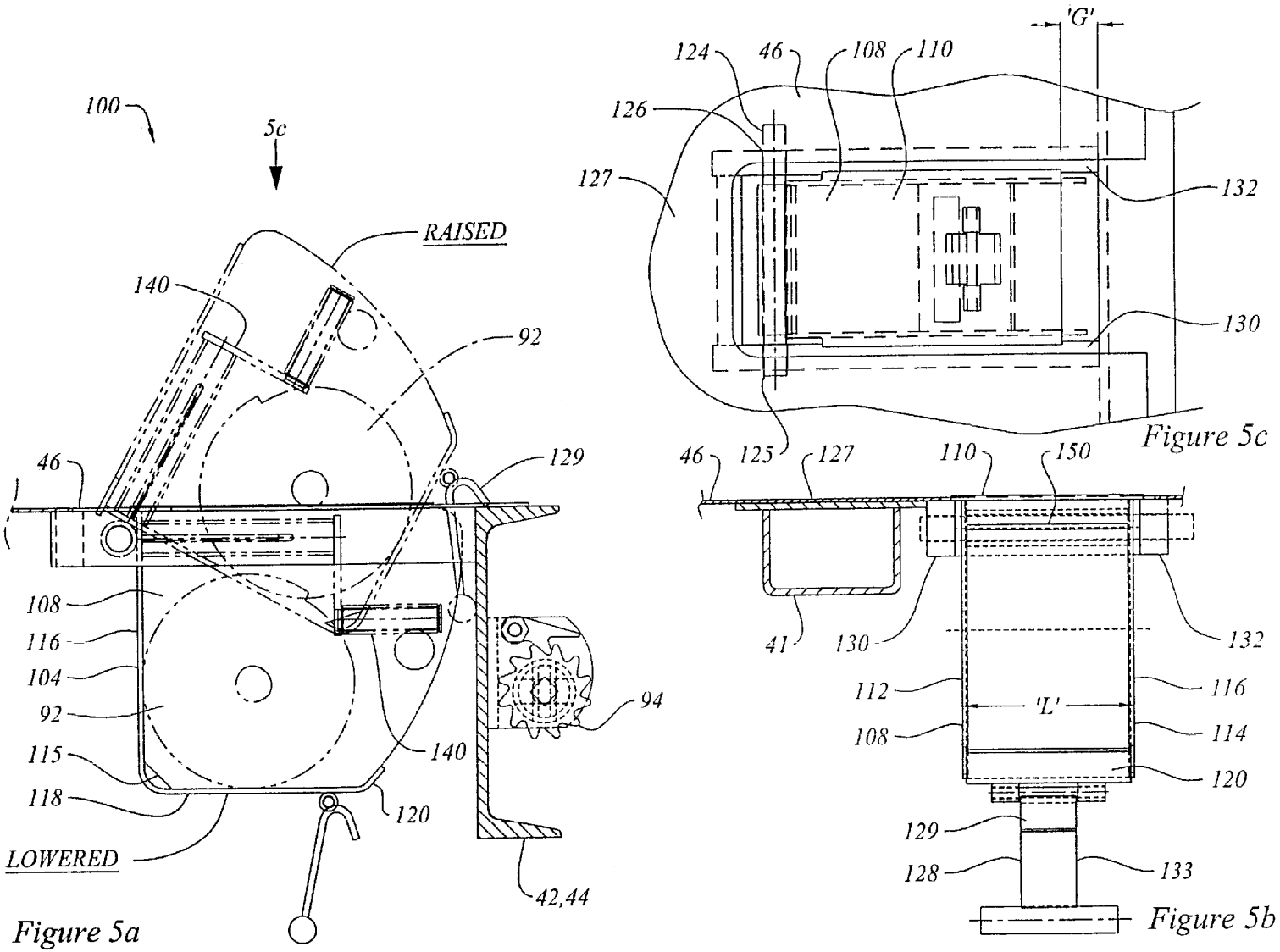
FIG. 5*a* shows a view of the storage box of FIG. 4*a* as installed on a rail car, showing the storage box in both raised and lowered positions.
FIG. 5*b* shows a side view of the installation of FIG. 5*a;*
FIG. 5*c* shows a top view of the installation of FIG. 5*a;*

A sleeve 122 is welded along the outer surface of back wall 116 adjacent to the junction of back wall 116 with top wall 110, and forms a pivot fitting on a shaft 124 (FIG. 5*c*) that is mounted between a pair of bores, 125, 126 formed in side bars 130, 132 mounted to the underside of the deck panel 127 adjacent to the cross-ties. As such, box 108 is pivotally mounted to move between a raised position, shown in phantom lines in FIG. 5*a* and a lowered, or storage position, shown in solid lines in FIG. 5*a*. The fourth, open portion of the periphery of side walls 112, 114 has an arcuate profile formed on a constant radius 'R' relative to the longitudinal axis of sleeve 122. Notably, top wall 110 is shorter than this radius, such that a gap 'G' (FIG. 5*c*) is left between the distal edge of top wall 110 and the inner edge of the side sill, be it 42, 44 as the case may be. The gap 'G' permits the lifting of the box 108 to the open, or raised position.

The long margins of top wall 110 each have a lip 131 extending beyond side walls 112, 114, respectively to overlap the respective upper faces of bars 130, 132. As such, bars 130, 132 also act as stops, or abutments limiting the travel of box 108 into the stored position. A retention fitting for maintaining box 108 in an open, or raised position is also provided. That is, a stay or prop in the nature of a pivotally mounted catch 128 is mounted to the underside of bottom wall 118 near lip 120. Catch 128 has a hook shape, with one end being identified as a bent hook 129. Catch 128 is pivotally mounted to box 108, and the long depending end 133 being left to dangle, the long depending end having a piece of round stock 135 (FIG. 4*c*) welded to it. When box 108 is raised, as by lifting the distal edge of top panel 110, the free end of hook 129 rides against the back, or inboard face of the web, of the side sill 42, 44. The weight of the rest of the hook will tend to keep hook 129 in contact with the side sill web until hook 129 clears the upper corner of the side sill web where it meets the side sill upper flange. At that point the free end of hook 129 being biased due to gravity acting on round stock 135, will tend to move outwards, and the long end 133 will tend to swing out to contact the web of the side sill. If box 108 is lowered slightly, hook 129 will catch as shown in phantom in the raised position of FIG. 5*a*. To release, box 108 is raised to take the weight off hook 129. Hook 129 is pushed inward, and box 108 is lowered until the overhanging edges, lips 131, of top wall 110 abut the upper surfaces of bars 130, 132.

A clevis, or yoke, is formed by a pair of first and second bores 134, 136 let through each of side walls 112, 114 near the fourth portion of their respective peripheral margins. Bores 134 and 136 are provided to give a socket for web reeling device 102, in the nature of a winder, or crank 140. Crank 140 has a shaft 142 engageable with bores 134, 136; an arm, 144 extending radially from one end of shaft 142; and a throw, or handle, 146 by which crank 140 can be grasped and a torque imposed through arm 144 to turn shaft 142. Shaft 142 is a slotted shaft, slot 148 being of a size to accept radial threading by an end of a web band, namely strap 92. As such, when box 108 is in the raised, or operative position, crank 140 can be used to reel up strap 92 in a loose roll, or coil. Then, turning crank 140 backwards slightly, (in the direction opposite to the winding direction), may tend to loosen strap 92 in the center of the coil thus formed, thereby facilitating axial disengagement. Axially withdrawing shaft 142 out of the socket provided by bores 134, 136, may then tend to release the formed coil, or roll, permitting it to fall into the storage space defined within the walls of box 108.

Box 108 also has a crank storage fitting in the nature of an intermediate internal plate, or web 150 (FIG. 4*b*) mounted parallel to top wall 110, the width of web 150 being approximately equal to the small dimension 'L' and the thickness of web 150 being thinner than the width of slot 148. Before box 108 is lowered, slot 148 of shaft 142 of handle 140 is fed axially onto web 150, with handle 146 hanging downward. When box 108 is lowered, crank 140 may then tend to be trapped in a position for travelling. It is not necessary to have a crank for every storage box. That is, a single crank (or, preferably, at least one crank per car side) could be used to reel all of the web bands of a car. It may also be noted that inasmuch as shaft 142 can be introduced in either direction through bores 134, 136, crank 140 can be operated either left handed or right handed.

Figure 6C:
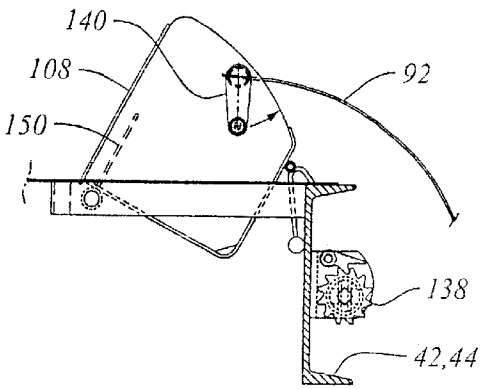
FIG. 6*c* shows the storage box of FIG. 6*a* with an end of a web band fed through the crank, at the start of winding.
Figure 6F:
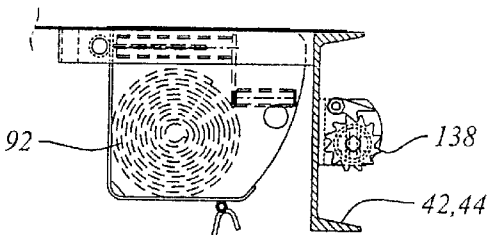
FIG. 6*f* shows the storage box of FIG. 6*a* full and placed in the lowered position.
Figure 6B:
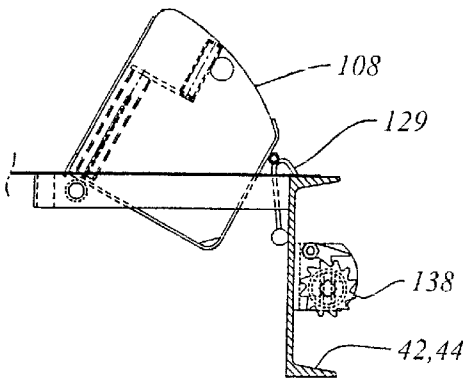
FIG. 6*b* shows the storage box of FIG. 6*a* in a raised position.
Figure 6E:
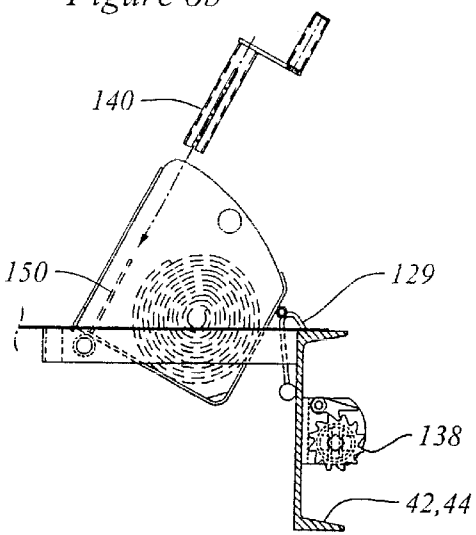
FIG. 6*e* shows the storage box of FIG. 6*a* with the reel fully wound and crank removed.
Figure 6A:
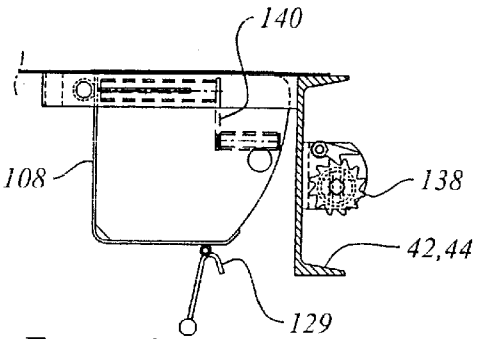
FIG. 6*a* shows a view similar to FIG. 5*a,* of an empty storage box.
Figure 6D:
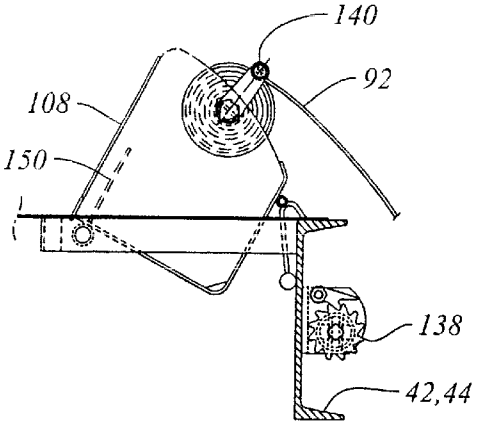
FIG. 6*d* shows the storage box of FIG. 6*c* during reeling of the web band.

The sequence of operation of the lading securement storage apparatus is shown in FIGS. 6*a* to 6*f*. The sequence occurs after the web bands have been released from their tightening mechanism 94, namely winches 138, and the lading removed from car 20. Yard personnel have collected the web bands and it is time for the bands to be placed in storage for the empty car return. In FIG. 6*a*, box 108 is empty and rests in a first, retracted, stored or inoperative position, however it may be termed. In FIG. 6*b*, box 108 has been raised by pivotal motion about the hinge formed by sleeve 122 and shaft 124. Hook 129 engages side sill 42, 44 to maintain box 108 in the second, raised or operative position. In FIG. 6*c*, crank handle 140 has been removed from its storage position inside box 108, and has been inserted into the socket formed by the co-operation of bores 134, 136. A free end of a strap 92 has been threaded radially through slot 148. An arrow indicates counter-clockwise rotation of handle 146 of crank 140, thus turning shaft 142 and commencing winding of strap 92. FIG. 6*d* shows strap 92 in a partially coiled state. FIG. 6*e* shows the fully coiled strap 92 resting in the bottom of box 108 after shaft 142 has been withdrawn from bores 134, 136 thus disengaging the coil from crank 140 and permitting it to fall. Crank 140 is then replaced in its storage position on web 150, and box 108 is lowered into the storage position shown in FIG. 6*f*.

Other arrangements of box positioning or retaining devices can be used than the hooked stay of box 108. In the further alternative shown in FIGS. 7*a* and 7*b*, a box 190 is similar to box 108 in general layout and construction. Rather than having catch 128, box 190 has a cable 192 (or a chain) having a pull ring 194. Side sill 42, or 44 has a key-hole shaped notch to accommodate the passage of cable 192. Cable 192 is attached at its inboard end to an arm 194 mounted to the back wall 196 of box 190. Cable 192 is then carried about the rounded, smoothly radiused corner of lip 198 and through side sill 42 or 44 as the case may be. An arresting member in the nature of a ferrule acts as a stop, or retainer 200 engageable with the narrow lower portion of the key-hole notch in the web of the side sill to maintain box 190 in the raised position shown in FIG. 7*a*. The upper portion of the keyhole is of sufficient size to permit passage of retainer 200 and thus to release box 190 for lowering to the lowered, or storage position shown in FIG. 7*b*.

Figure 4A:
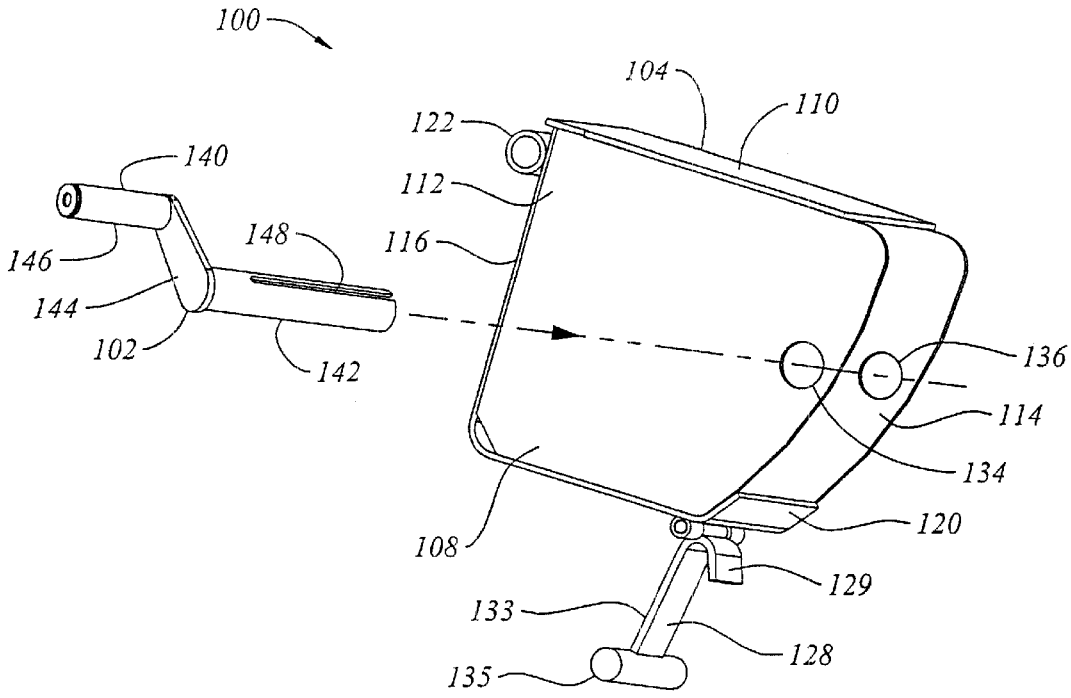
FIG. 4*a* shows an isometric view of a storage box and co-operating crank for suitable for use with the center beam rail road car of FIG. 1*a;*
Figure 4B:
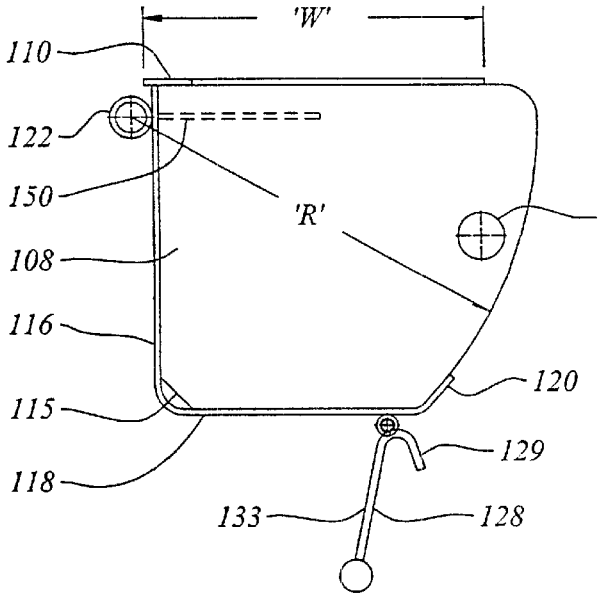
FIG. 4*b* shows a side view of the storage box of FIG. 4*a;*
Figure 4C:
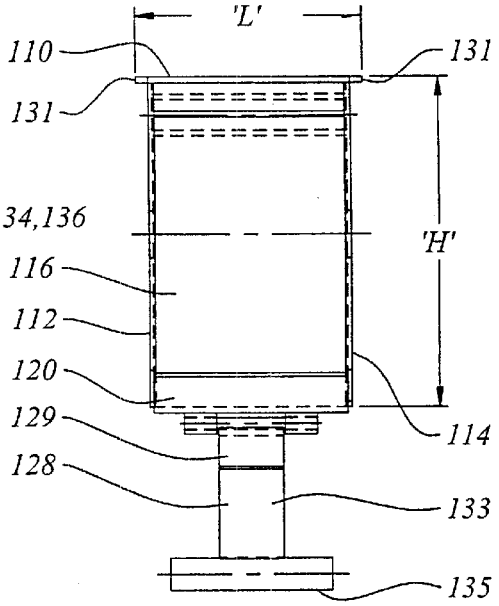
FIG. 4*c* shows an end view of the storage box of FIG. 4*a;*
Figure 7A:
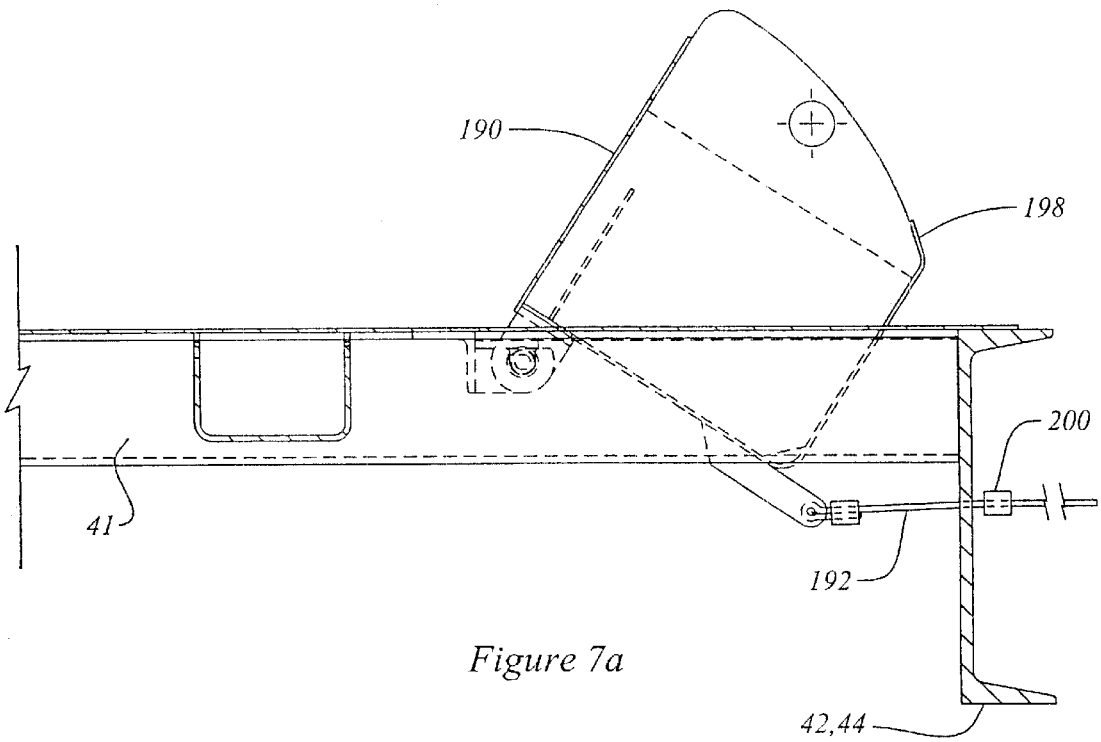
FIG. 7*a* shows an alternate storage box to that of FIG. 6*a* having a different position retention mechanism.
Figure 7B:
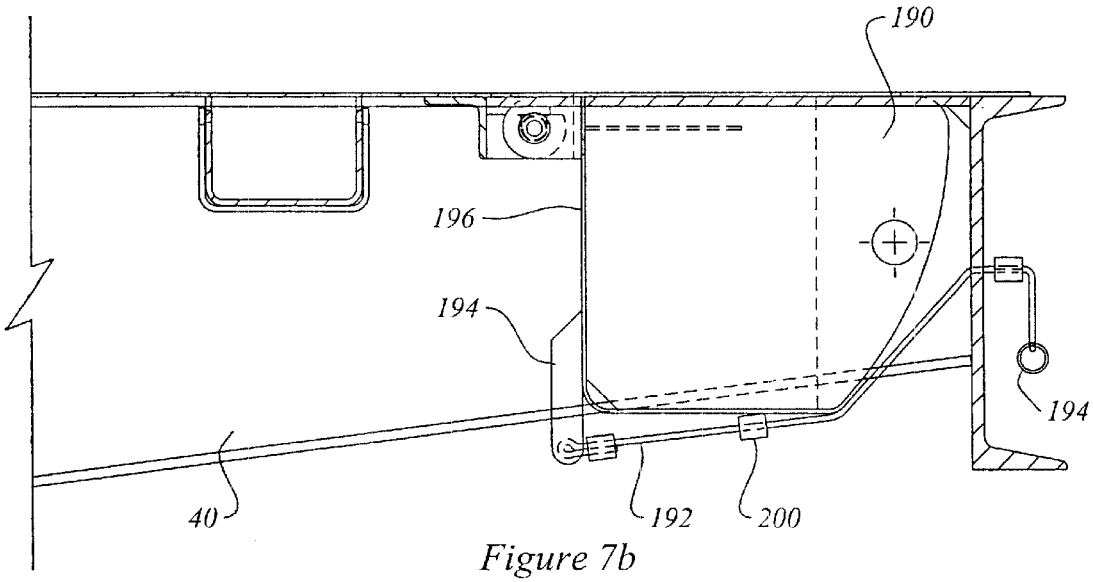
FIG. 7*b* shows the storage box of FIG. 7*a* in the lowered position.
Figures 7C, 7D:
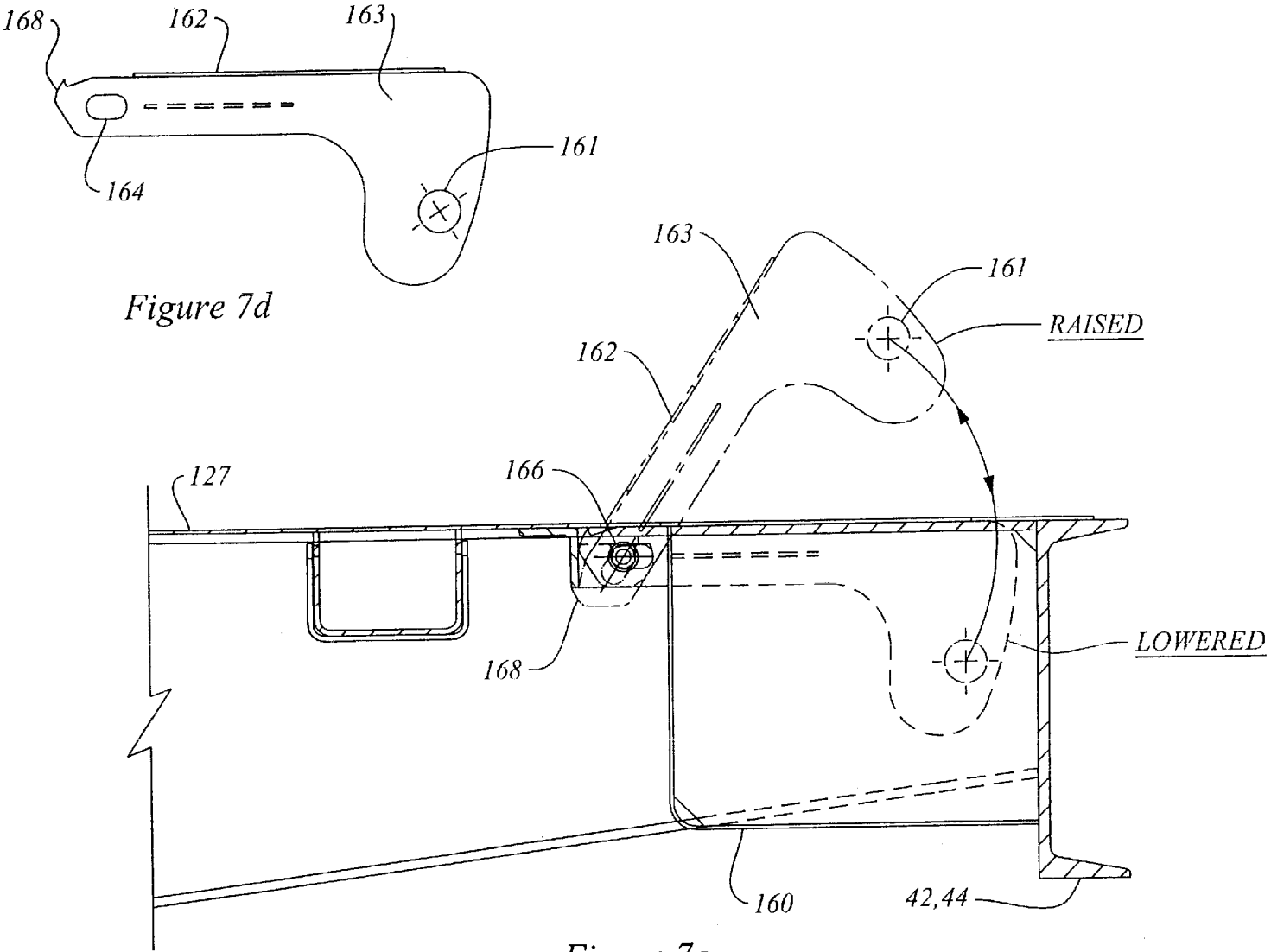
FIG. 7*c* shows an alternate arrangement showing a movable crank holder and fixed storage box.
FIG. 7*d* shows the movable crank holder of FIG. 7*c;*

The storage box may not necessarily be movable between the raised and lowered, stored and operative, positions as shown for box 108 in FIG. 7*a*. In an alternate embodiment, as shown in FIGS. 7*c* and 7*d*, a stationary storage box 160 is provided, with a movable lid, 162 that has parallel side flanges 163 that have a profile cut foot in which apertures 161 are formed to function in co-operation as a yoke, or clevis for the shaft of a crank, such as crank 140. Flanges 163 each have an oblong slot 164 traversed by a hinge pin 166; and a retaining mechanism, or stay, in the nature of a notched detent 168 to permit it to remain in a raised position for winding. In this embodiment the amount of weight to be raised and lowered is reduced when the majority of the box is stationary. By contrast, an advantage of the embodiment of FIG. 4*a* is that it may tend to permit the winding mechanism and storage assembly to be formed in a single unit to which crank 140 mates. That is, the side walls serve two functions, first as portions of a storage assembly to restrain the wound coils, second to act as the support structure, or yoke, or clevis of a winding apparatus with the crank 140.

Figure 8A:
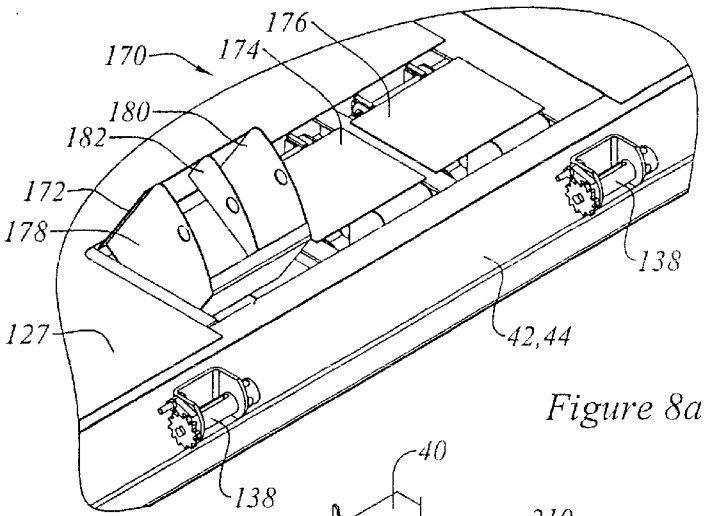
FIG. 8*a* shows an array of double reel storage boxes as an alternative to the installation of FIG. 7*a;*
Figure 8B:
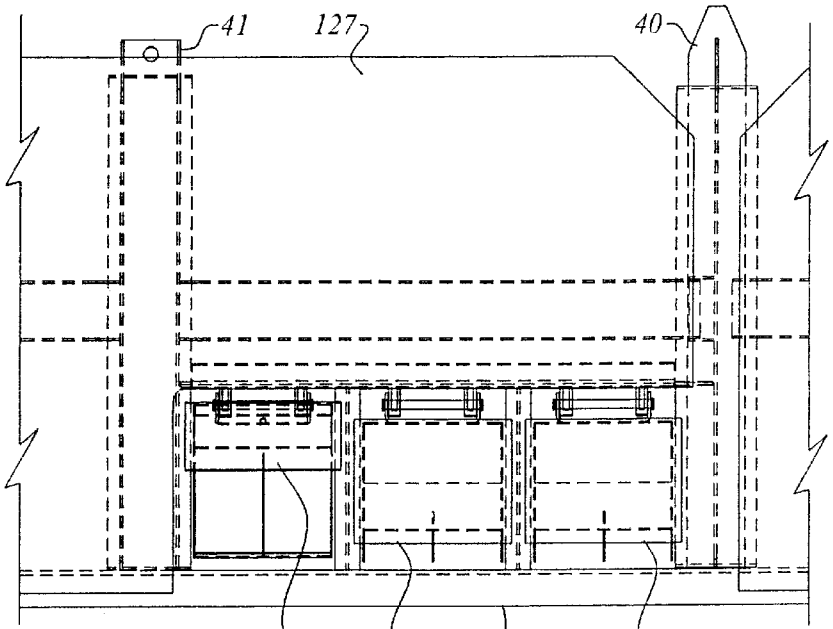
FIG. 8*b* shows a top view of the installation of FIG. 8*a;*
Figure 8C:
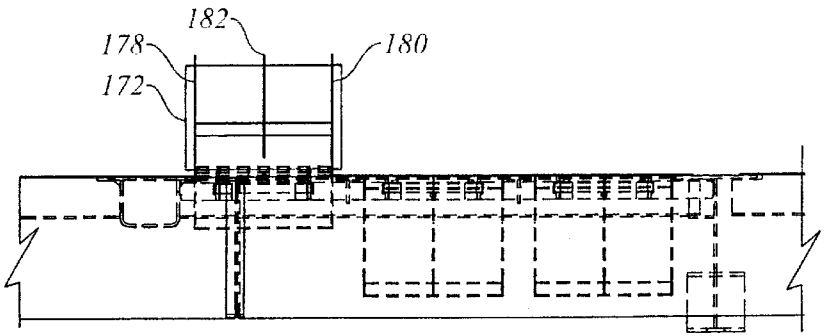
FIG. 8*c* shows a side view of the installation of FIG. 8*a;*

It is also not necessary for the boxes to be spread along the bays at the pitches of successive cross ties. It may be found to be more convenient to mount a larger number of boxes in a single location, and to wind reels, or spools, of web bands in one place. Such an arrangement is show in the further alternative of FIGS. 8*a*, 8*b* and 8*c*. In this instance a group of boxes 170 is mounted together inboard of a side sill 42, or 44, as may be. In this instance, each box 172, 174 or 176 is similar to box 108 in layout and construction, but rather than being a single box, is instead a double box having two chambers side by side and is capable of holding two coiled spools, each box having not only side walls 178, 180, but also an intermediate partition 182. As before, a crank 140 is stored within one or another of the boxes. Each box is movable between a raised position, as shown by box 172, and a lowered position as shown by box 174 or 176.

Figure 9A:
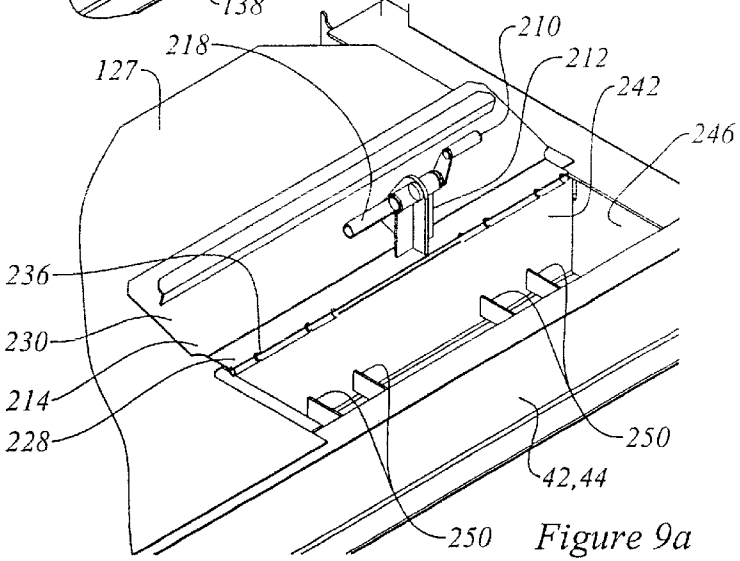
FIG. 9*a* shows an alternate winding and storage apparatus installation to that of FIG. 8*a;*
Figure 9B:
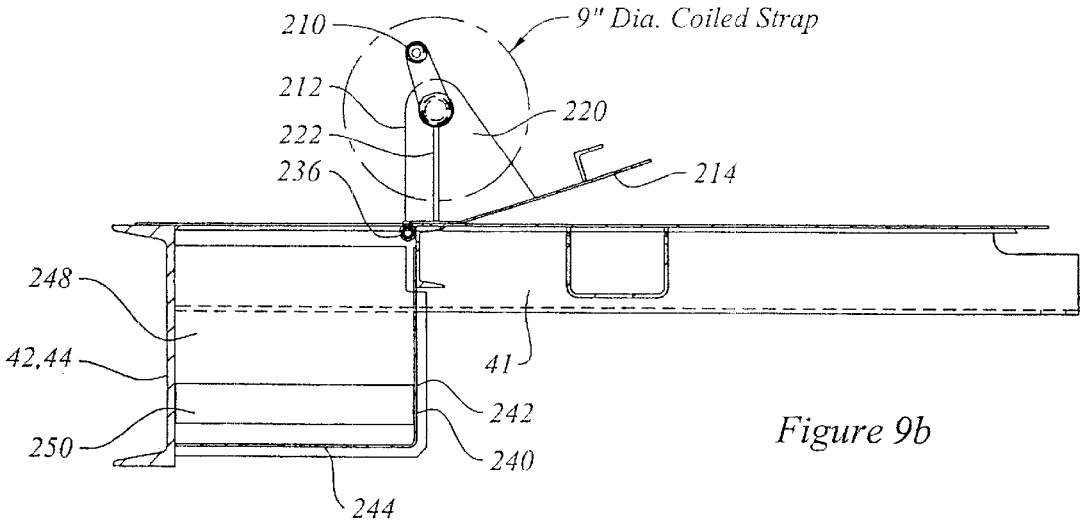
FIG. 9*b* shows a side view of the apparatus of FIG. 9*a* in a raised position.
Figure 9C:
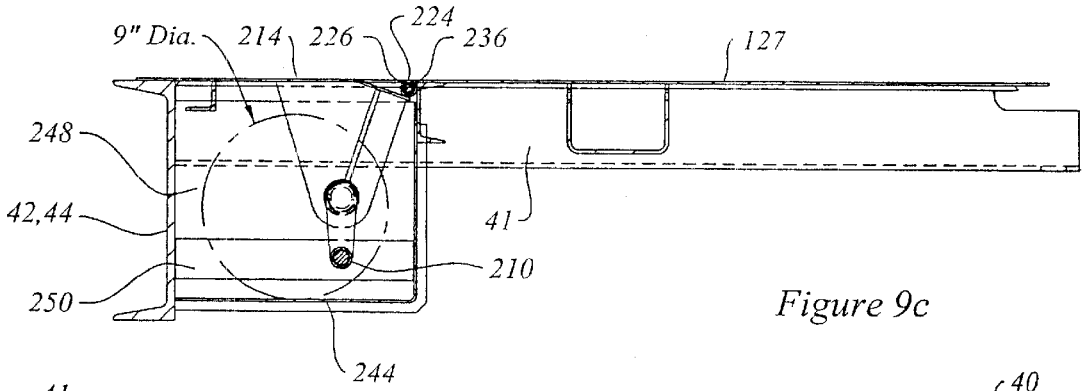
FIG. 9*c* shows a side view of the apparatus of FIG. 9*a* in a lowered position.
Figure 9D:
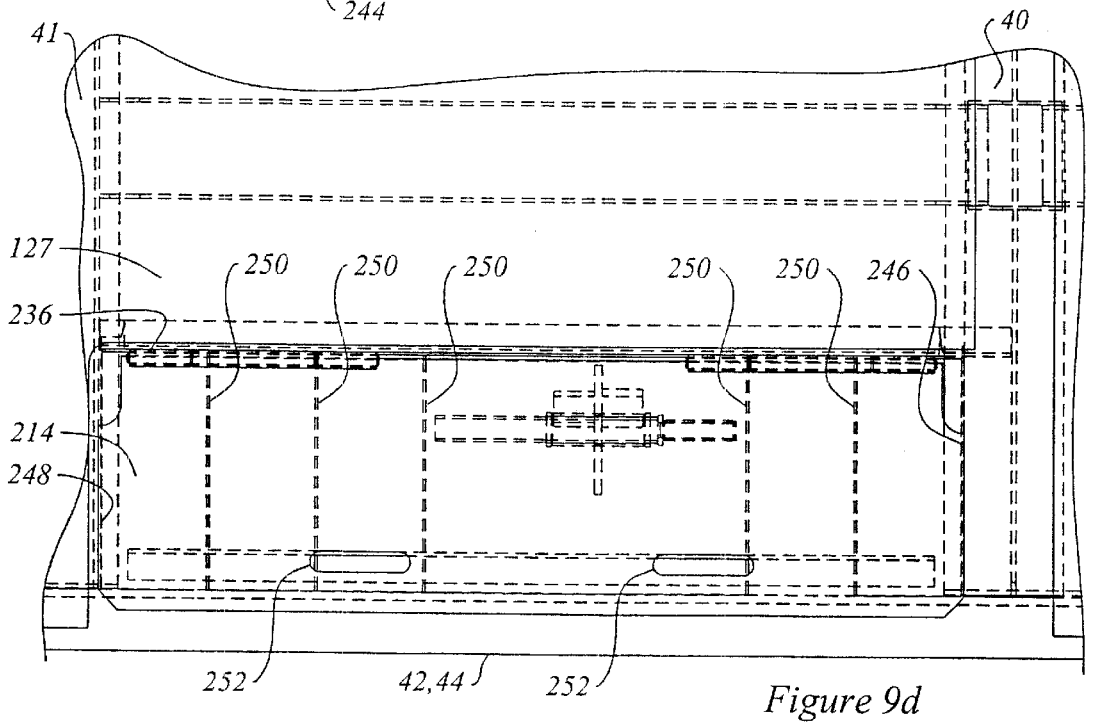
FIG. 9*d* shows a top view of the apparatus of FIG. 9*a* in the lowered position.

In the alternative embodiment of FIGS. 9*a*, 9*b*, and 9*c*, a different crank mechanism can also be employed in which the crank handle, being inseparable from the structure, may be less prone to being misplaced. FIG. 9*a* shows a crank 210 mounted to a pedestal, or stanchion 212, that is, itself, mounted to a pivoting deck plate 214. When the plate is lowered, as in FIG. 9*c*, crank 210 is located in an inoperative position clear of the lading envelope of the deck structure of the car, namely shy of the plane of the lading support structure of the deck generally. When the plate is raised, as shown in FIG. 9*a* or 9*b*, crank 210 stands generally upwardly of the plane of the deck structure, and as so exposed is ready for use in forming web bands, namely straps 92 into coils or spools.

In greater detail, stanchion 212 includes a tapered upstanding web 220 (FIG. 9*b*) welded perpendicularly to plate 214 and perpendicular to the axis of rotation of shaft 218 of crank 210. The axis of rotation of crank 210 is parallel to the longitudinal axis of the rail car more generally. Stanchion 212 also includes a right-angled web 222 mounted centrally to web 220 and rooted to plate 214 such that webs 220 and 222 co-operate to give reinforcement both longitudinally and transversely. The hinge sleeve 224 (FIG. 9*c*) for plate 214 is mounted to the deck structure shy of the plane of the deck, such that the axis of rotation of the hinge shaft 226 is also below deck level. When plate 214 is in the retracted, or stored position, the staff, or proximal portion 228 (FIG. 9*a*) of plate 214 is welded tangent to sleeve 224 on an angle, the point of tangency also being below the plane of the deck generally. Proximal portion 228 extends angularly upward to meet the distaff, or distal portion 230 of plate 214. Distal portion 230 lies flush, or marginally shy, of the plane of the deck when crank 210 is in the storage position, and thus has a dog-leg orientation relative to proximal portion 228. When plate 214 is moved to the open, or raised, or operative position of crank 210, proximal portion 228 is intended to lie flush against the adjacent portion of the deck lying inboard of hinge 236, as shown.

In the closed position crank 210 locates within an enclosed spaced defined by a stationary storage box structure 240 (FIG. 9*b*). Box 240 has a back, or laterally inboard, wall 242, a bottom wall 244 and end walls 246 and 248. The remaining front wall is defined by the web of side sill 42, 44, as the case may be. Intermediate partitions, identified as webs 250 are space along bottom wall 244 to divide box 240 into a series of bunks, or niches, or catchments, into which reeled straps can be placed. Webs 250 are of less than full height, being of a height to correspond to a minor sector of the reel, high enough to tend to discourage lateral displacement of the formed reels, but low enough to tend to facilitate hand retrieval of the reels when needed. The niches so formed lie to either side of the retracted position of crank 210. Plate 214 has fittings in the nature of oval hand grip openings 252 by which a person can raise and lower crank 210 with plate 214.

Figure 1B:
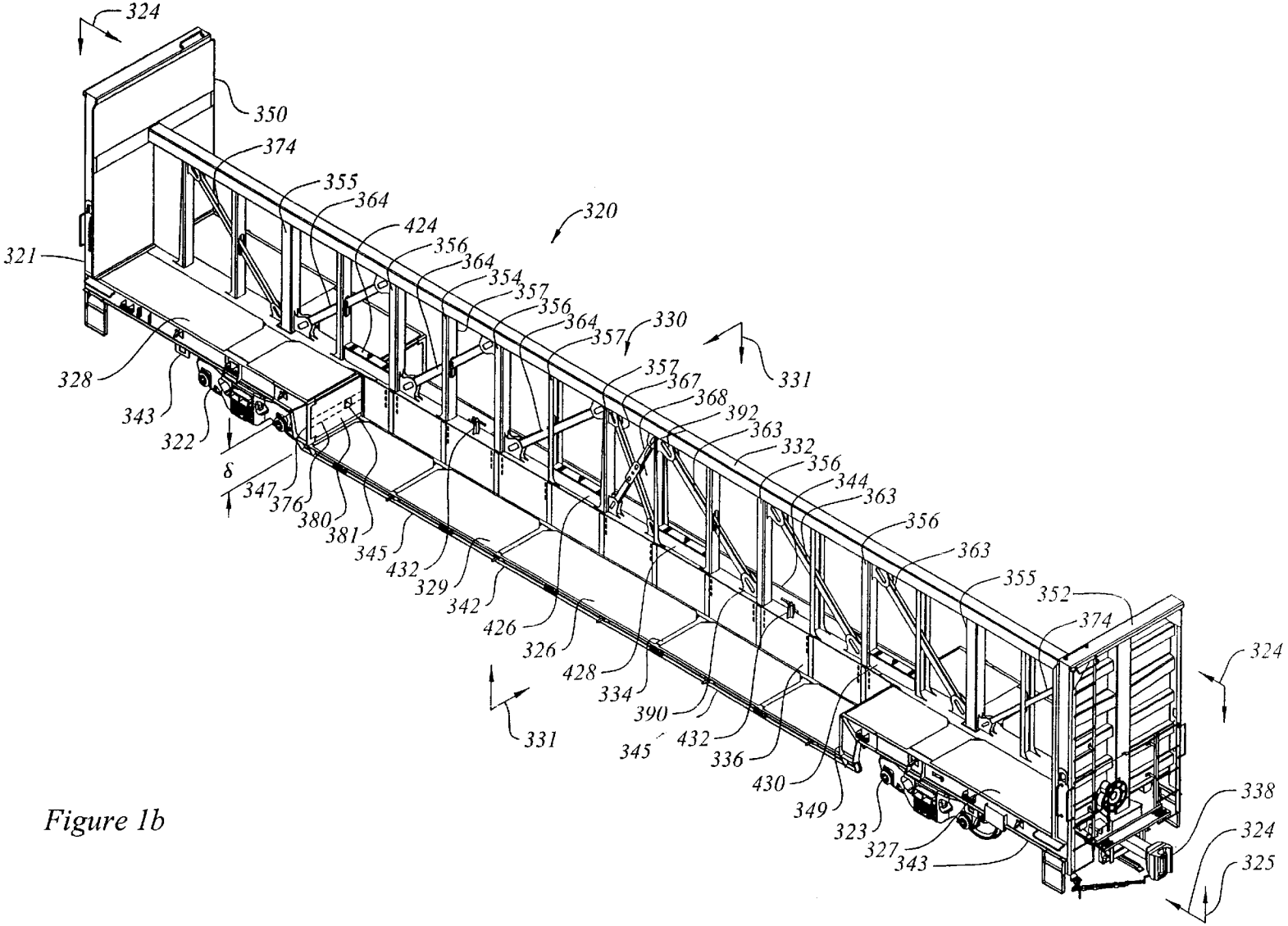
FIG. 1*b* shows an isometric, general arrangement view of a dropped deck center beam rail road car with a reduced height top chord without a laterally extending truss, an alternative to the center beam rail road car of FIG. 1*a;*

In a still further alternative, shown in FIG. 1*b* there is a dropped deck center beam car 320. It has a center beam rail road car body 321 supported by, or carried on, a pair of longitudinally spaced apart railroad car trucks 322 and 323 and is operable to roll in a longitudinal rolling direction along rails in the general manner of rail cars. Car 320 has a longitudinal centerline 325 lying at the center of the coupler height in a longitudinal plane of symmetry, indicated generally as 324. Plane 324 intersects pin connections of trucks 322 and 323 at the center plates of the trucks. Car 320 has a deck structure 326 upon which cargo can be placed. Deck structure 326 has elevated end deck portions 327, 328 and a medial deck portion 329, carried between the trucks at a height, relative to the top of rail (TOR) that is lower than the height of the end deck portions 327, 328.

In the case of car 320, the central web assembly is indicated generally as 330 and runs in the longitudinal direction (that is, the rolling direction of the car), the top flange function is served by a top chord 332, and the lower flange function is performed by an assembly that includes a lateral support structure 334, and a main center sill 336. Lateral support structure 334 generally includes deck structure 326, and its outboard left and right hand side sills 342 and 344 (FIG. 1*b*).

As with car 20, described above, aside from fittings such as hand grabs, ladders, brake fittings, and couplers, the structure of car 320 is symmetrical about the longitudinal plane of symmetry 324, and also about the transverse plane of symmetry 331 at the mid-length station of the car. In that light, a structural description of one half of the car will also serve to describe the other half. The features of car 320 thus enumerated are basic structural features of a center beam car having a depressed center deck.

In detail, main center sill 336 is a fabricated steel box beam that extends longitudinally along centerline 325 of car 320 throughout its length, having couplers 338 mounted at either end. Cross bearers 340 and cross-ties 341 extend outwardly from center sill 336 to terminate at left and right hand side sills 342, 344 that also run the length of the car. These cross bearers 340 and cross ties 341 extend laterally outward from center till 336 on approximately 4 ft centers. Deck sheeting, identified as decking 326, is mounted to extend between cross-bearers 340 and cross-ties 341, providing a shear connection between opposing side sills when side loads are imposed on the car, as in cornering. The combined structure of center sill 336, cross-bearers 340, cross-ties 341, side sills 342, 344 and decking 326 provides a wide, lading support assembly extending laterally outward from the longitudinal centerline 325 of car 320.

As noted above, deck structure 326 has a first end portion, namely end deck portion 327, a second end deck portion, namely end deck portion 328, and a medial deck portion 329. At each of the transitions from either end deck portion 327 or 328 to medial deck portion 329 there is a knee, indicated respectively as 347 or 349. Not only is deck structure 326 stepped in this manner, but so too are side sills 342 and 344, each having first and second end members, or end portions, 343, and a medial member, or medial side sill portion 345.

At either end of car 320 there are vertically upstanding fore and aft end bulkheads 350 and 352 which extend from side to side, perpendicular to the central longitudinal plane 324 of car 320. Running the full length of car 320 between end bulkheads 350 and 352 is an array 354 of upright posts 355, 356, 357. Array 354 is reinforced by diagonal braces 363, 364, 367, 368, 374 that provide a shear path for vertical loads. The array 354 of posts 355, 356, 357 is surmounted by an upper beam, namely top chord 332 to form a central beam assembly standing upwardly of the deck structure. In this central beam structure, array 354 and the diagonal braces co-operate to provide a shear transfer web-like structure between center sill 336 and top chord 332. As shown, end bulkheads 350 and 352 are taller than the central beam assembly. That is, taken relative to top of rail, the height of the top of the bulkheads is greater than the height of the upper extremity of top chord 332. As such, car 320 is a dropped deck center beam rail road car having a reduced height top chord without laterally extending truss wings.

The respective end deck portions 327, 328 are offset upwardly from the lading supporting structure of medial deck portion 329 by a height increment shown as 8 (FIG. 1*b*). The step increment may correspond to the height of a nominal 31½ inch bundle of lumber, plus dunnage, (that is, 31½ inches of lumber plus 1½ inches of dunnage), totalling 33 inches plus a tolerance for an actual step height of 33⅝ inches (+/−⅛ inches).

Straps 386 (FIG. 1*c*) are provided to wrap about the load, and to be tightened by a winch 388, or similar tightening mechanism mounted to the respective side sill 342 or 344. An operator turns winch 388 with the aid of an extension bar or handle or ratchet drive (not shown). When tightened, straps 386 bear against the outboard, upper corners of the L5 bundles, tending to force their inboard, upper regions, tightly together, and tending to cause the L5 bundles to be drawn down tightly atop the L4 bundles, thus tightening the stack from L1 to L5. Straps 386 are anchored on the far side of the car to load securing, or anchoring, means in the nature of bent-rod hooks 389 or another winch mechanism such as winch 388.

The height of the knee, preferably roughly 33 to 34 inches, may tend to be a bit large for a person to ascend comfortably as a single step. For the purpose of facilitating end deck access, a vertically extending, transversely oriented intermediate bulkhead sheet 380 has a perforation formed in it at the height of medial cross-member 376 to define a foothold, rung, or step, 381 (on FIG. 1*b*).

Center beam car 320 has an array of center beam web posts, indicated generally as 354 in the context of FIG. 1*b*. Posts 356, 357 (and 355) thus present smooth, planar surfaces to the lading with smoothly radiused corners. Each diagonal member, whether struts 363, 364 or braces 367, 368 (or 374) has a first end rooted at a lower lug such as lower lug 390, welded at the juncture of one of posts 356 (or 355) with main center sill 336; and a second diagonal end rooted in an upper lug 392 at the juncture of another adjacent post 356 (or 357) and top chord 332. Midway along its length, the diagonal member, whether struts 363, 364 or braces 367, 368, passes through the post 357 intermediate the pair of posts 356 (or 355 and 356 or 357) to which the diagonal member is mounted. It is intended that the respective sides of posts 355 and 356, and the flanges of posts 357 lie in the same planes on either side of the central plane 324 of car 320 to present an aligned set of bearing surfaces defining a generally inboard upright, or vertical, lading bunk interface against which lading can be placed. The side faces of posts 355 and 356 and the flanges of posts 357, lie roughly at right angles to end deck portions 327, 328 and medial deck portion 329, the deck portions defining an upwardly facing lower, or horizontal, lading bunk interface. This may tend to facilitate placement of square cornered bundles in stacks in the bunks defined to either side of central web 330.

Figure 1C:
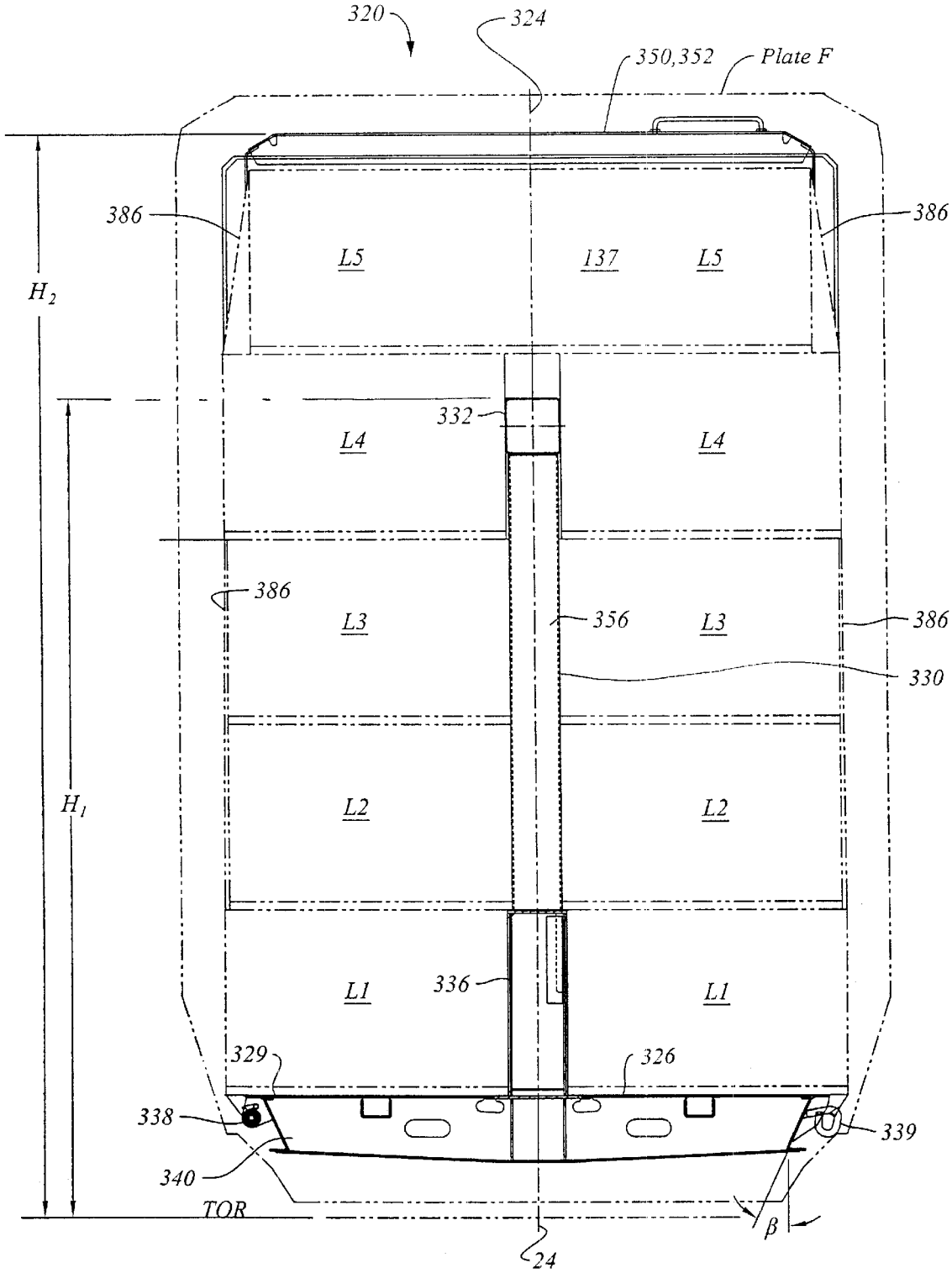
FIG. 1*c* shows a mid-span cross-section of the dropped deck center beam rail road car of FIG. 1*b;*

As shown in FIG. 1*c*, the longitudinal web structure of car 320 that includes array 354 of vertical posts 355, 356 and 357, and top chord member 332 extends to a first height H1 at the level of the top of the top chord, measured from top of rail, and the top of the end bulkheads, 350 and 352 extends to a second height H2, measured relative to top of rail. H2 is greater than H1, that is, the end bulkheads are taller than the central web structure. In the embodiment shown H2 exceeds the maximum height permitted under AAR Plate C, but falls within the maximum height envelope of AAR Plate F.

Figure 11A:
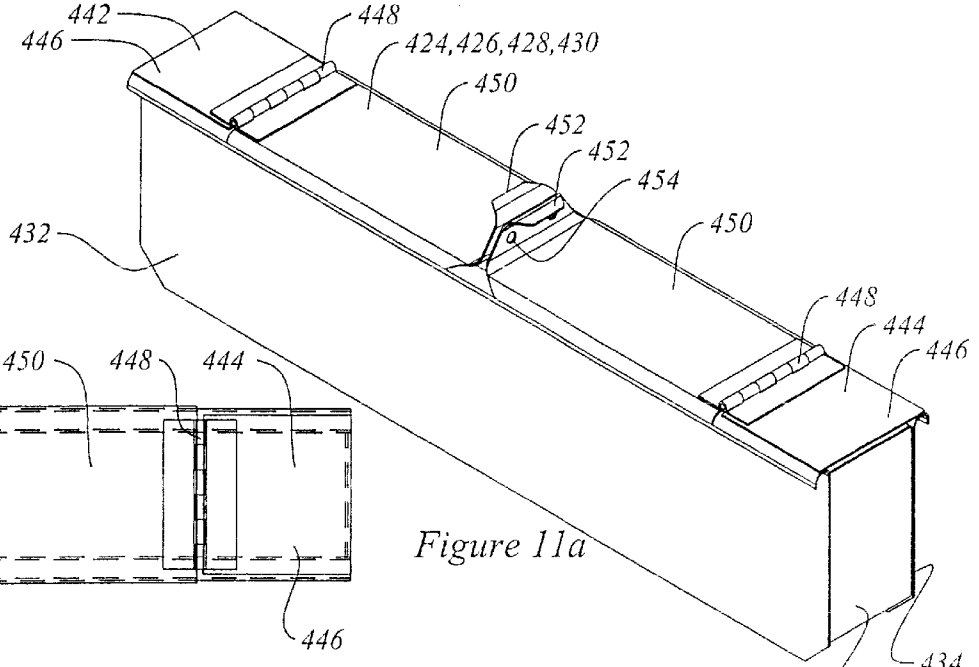
FIG. 11*a* shows an isometric view of a web band storage box for the center beam rail road car of FIG. 1*b;*
Figure 11B:
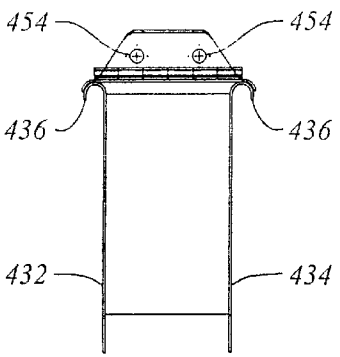
FIG. 11*b* shows a side view of the storage box of FIG. 11*a;*
Figure 11C:
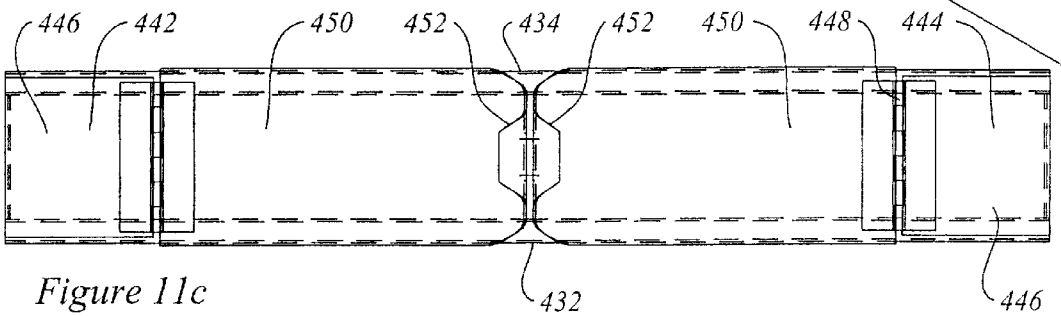
FIG. 11*c* shows a top view of the storage box of FIG. 11*a;*
Figure 11D:
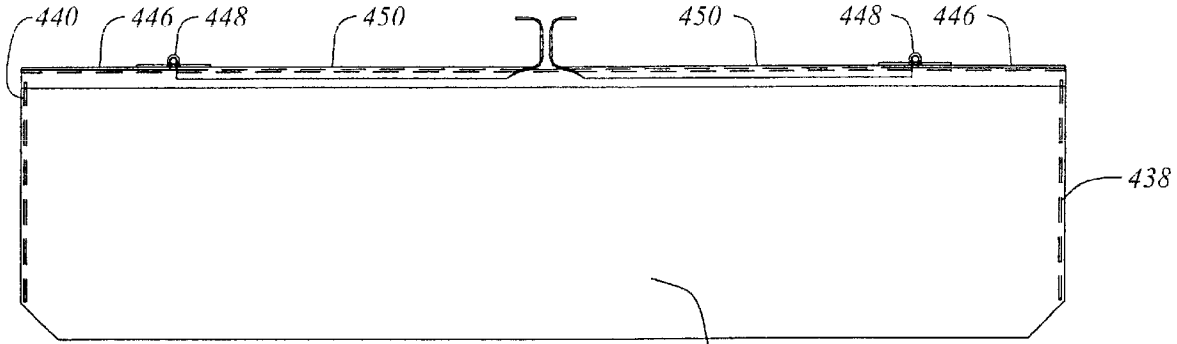
FIG. 11*d* shows a sectional view of the storage box of FIG. 11*a;*

The medial portion 329 of the deck structure of dropped deck center beam car 320 may tend to be accessible from track side by climbing without necessarily requiring the aid of a ladder or steps from the ground, thus tending to give access to storage boxes 424, 426, 428 and 430 mounted along the centerline of car 320 above the top cap of main center sill 336. A pair of first and second fore-and-aft cranks 432, 434 are mounted in fixed positions in the respective bays lying fore-and aft of storage boxes 424, 426, 428 and 430. Also, in this instance each storage box is capable of holding several rolled coils, and the storage boxes are not themselves provided with holes for engaging a winding mechanism. Rather, they have only movable lids, 450 (FIG. 11*a*). It would be possible to mount cranks above the storage boxes with the crank axis being transverse to the car such that rolls could be dropped off the crank directly into the storage boxes. However, it may be more common for the web bands to be fed in from the side of the car, a process that may tend to be facilitated if the axis of the shaft of the car runs fore-and-aft in a horizontal plane. Conveniently, car 320 also has a foothold 381 formed in the intermediate bulkhead sheet 380 at the knees by which yard personnel can ascend the raised end portions of the deck.

Figure 10A:
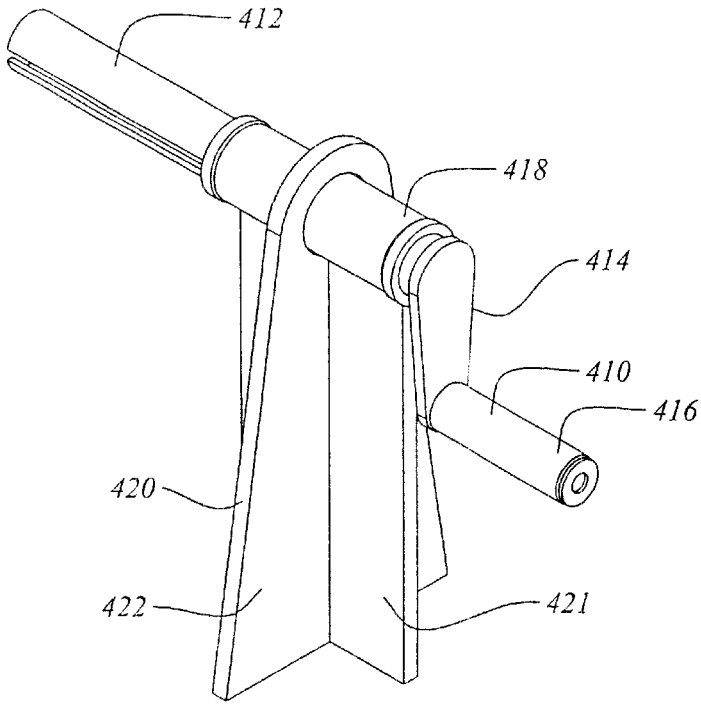
FIG. 10*a* shows an isometric view of a winding apparatus for the center beam rail road car of FIG. 1*b;*
Figure 10C:
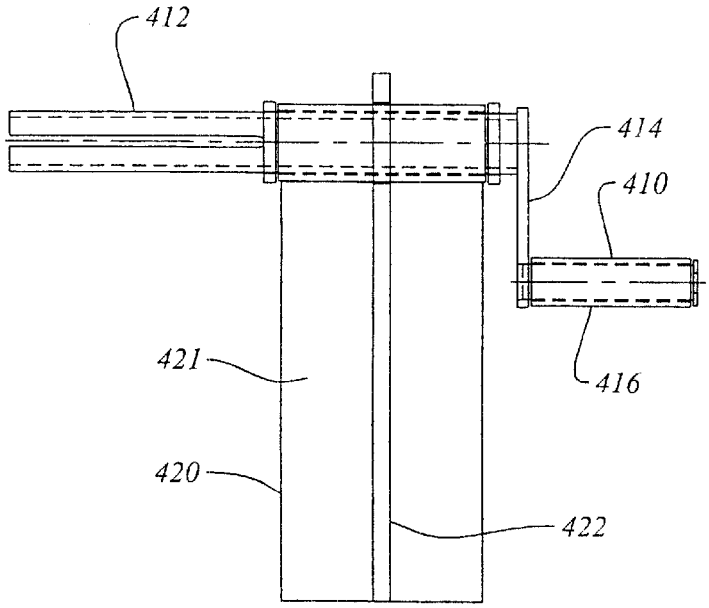
FIG. 10*c* shows a side view of the winding apparatus of FIG. 10*a;*
Figure 10B:
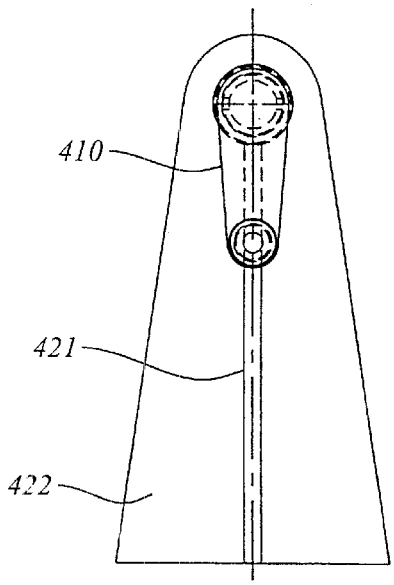
FIG. 10*b* shows an end view of the winding apparatus of FIG. 10*a;*

In greater detail, the strap winding mechanism of car 320 is as shown in FIGS. 10*a*, 10*b*, and 10*c*, and includes a crank 410 having a slotted shaft 412, a radially extending arm 414 connected to one end of shaft 412, and a handle, or throw 416 connected to the radially outward end of arm 414 by which a torque can be imposed on shaft 412. Shaft 412 is carried in a sleeve 418 in the nature of a section of pipe welded to a stanchion, or pedestal 420 having longitudinal and transverse reinforcing webs 421 and 422 respectively. Crank 410 is mounted above the top cap of main center sill 336 between a pair of the vertical posts as may be chosen.

As shown in FIGS. 11*a* to 11*d*, storage boxes: 424 to 430 each have a pair of vertical side plates 432, 434 having a smoothly radiused, roll-formed upper edge 436 to discourage the ingress of water and tearing of the reels. End plates 438, 440 co-operate with side plates 432, 434 to define a rectangular peripheral wall. The lower margins of side plates 432, 434 extend beyond the lowest extremity of end plates 438, 440 and provide overlapping tabs for facilitating drainage, painting and welding to the cap of main center sill 336. Top panels 442, 444 have stationary end portions 446, joined by hinges 448 to pivotable lid portions 450. Both the stationary and pivotable lid portions have roll farmed edges, or margins, that conform to the radius of the roll-formed upper edges of side plates 432, 434. The distal ends of pivotable lid portions 450 are chamfered and have a backwardly formed hand grip 452 by which pivotable lid portions 450 can be raised or lowered, thus controlling access to the opening defined between side plates 434, 436. Apertures 454 in hand grips 452 provide a location through which a lock can be placed to discourage unwanted removal of web bands. In the embodiment of FIG. 1*b*, boxes 424 and 430 differ from boxes 426 and 428 insofar as boxes 424 and 430 are somewhat shorter, accommodating 4 straps each, while boxes 426 and 428 accommodate 5 straps each with the axis of the reels oriented transversely relative to the longitudinal axis of car 320 generally.

Figure 12A:
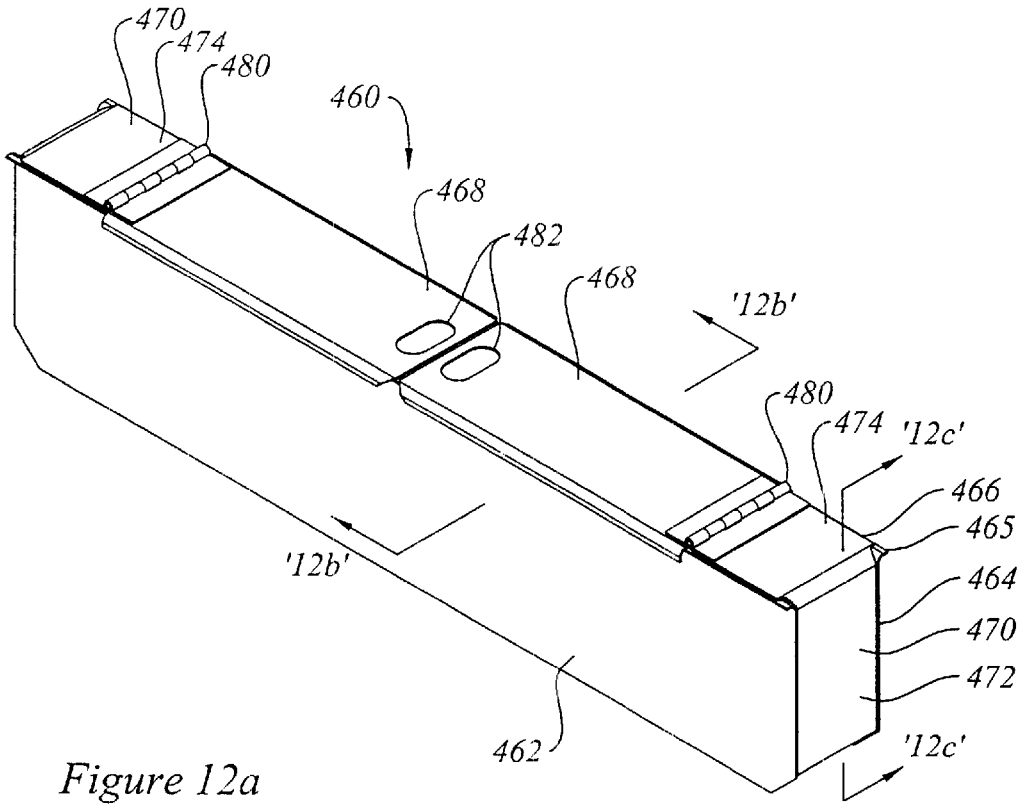
FIG. 12*a* shows an isometric view of an alternate web band storage box to that of FIG. 11*a;*
Figure 12B:
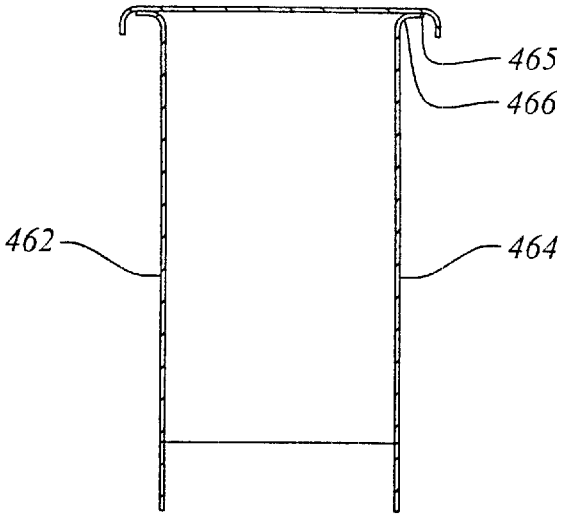
Figure 12C:
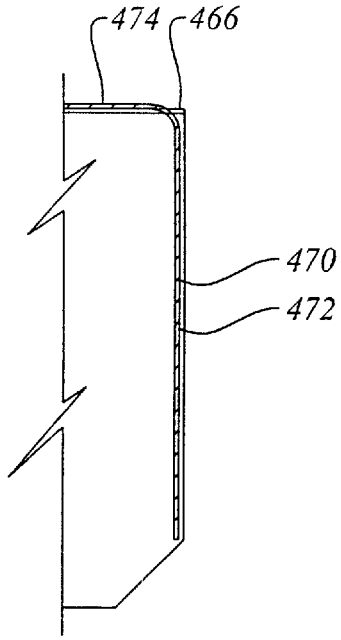
* and FIG. 12*c* shows a section view '12*c*—12*c*' of the storage box of FIG. 12*a.*

In another alternative, FIGS. 12*a* to 12*c* inclusive show storage box 460. Box 460 has a pair of vertical side plates 462, 464 having an upper edge 466 with a single, smoothly radiused bend 465, to discourage tearing of the reels, and to provide a landing, abutment, or stop for moveable lid members 468. At either end box 460 has a formed L-shaped end plate 470 having a vertical back member 472 and top member 474. Both end plates 470 co-operate with side plates 462, 464 to define a rectangular peripheral wall, end plates 470 being trimmed to conform to the bent upper edge of the side plates 462, 464. The lower margins of side plates 462, 464 extend beyond the lowest extremities of end plates 470, and provide overlapping tabs for welding to the cap of main center sill 336. This relationship facilitates the painting of this apparatus, and provides appropriate drainage. Lid members 468 are pivotally joined by hinges 480 to top members 474. The pivotable members 468 have smoothly radiused, bent, edges, or margins, that conform, or abut, to the smoothly radiused bend 465 at the upper edges, or margins, of side plates 462, 464. The distal ends of pivotable lid members 468 are chamfered, and have fittings in the nature of oval handgrip openings 482 by which a person can raise and lower pivotable members 468. Oval handgrip openings 482 also provide a location through which a lock can be placed to discourage unwanted removal of web bands.

Figure 1D:
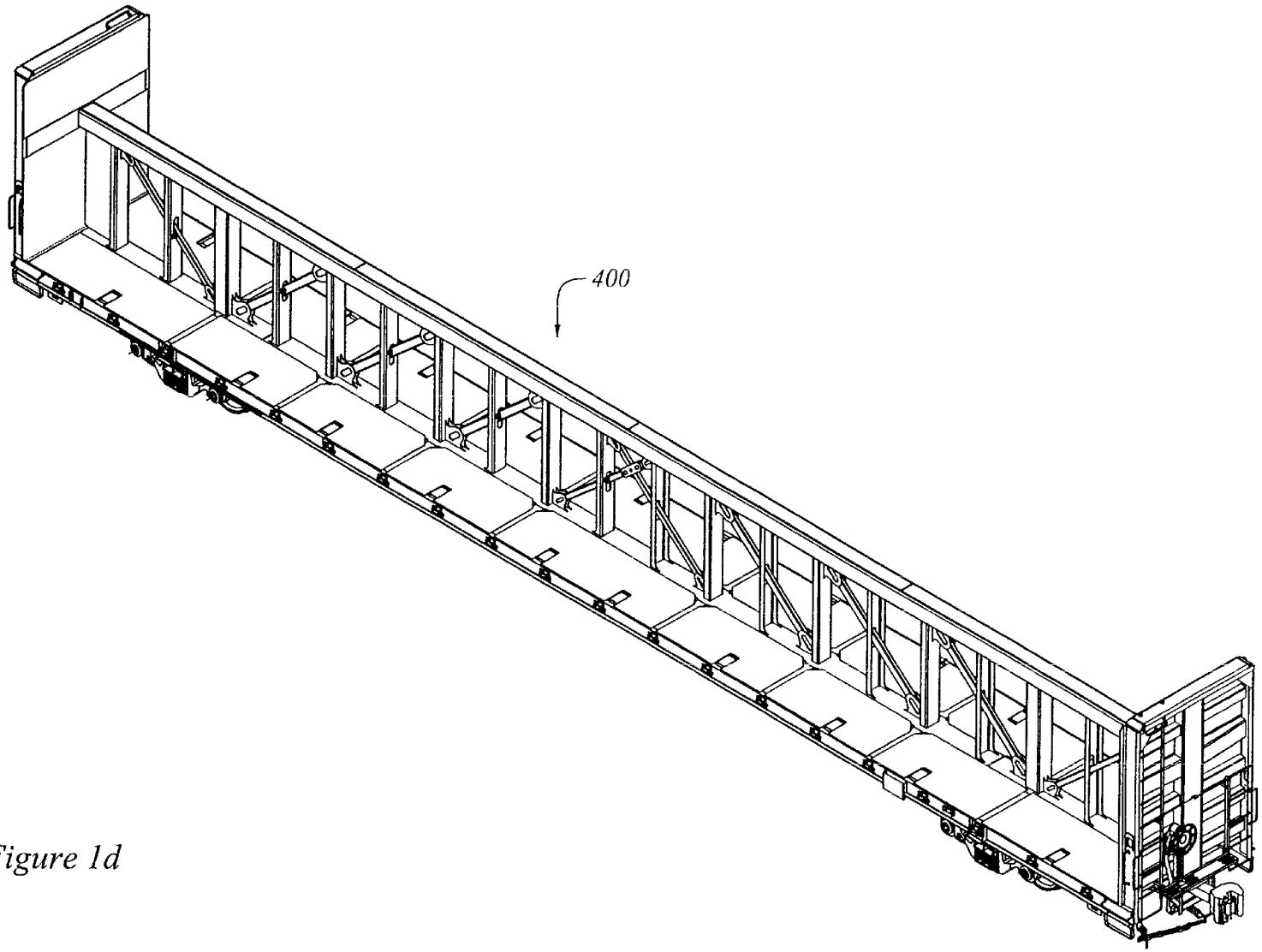
FIG. 1*d* shows an isometric, general arrangement view of a center beam rail road car having a straight-through main deck and a reduced height top chord, another alternative to the center beam rail road car of FIG. 1*a;*

In the foregoing examples, car 20 has a deck having tapered risers, posts inclined to match the taper to form a right angle, and an overhead top truss with laterally extending wings. Car 320, by contrast, has a dropped deck configuration, has planar horizontal decks, posts with parallel vertical sides, a top chord that is located at a reduced height relative to the end bulkheads, and no top truss. For the purpose of avoiding redundant description, it will be understood that these features can be combined in other configurations. That is, a straight-through flat deck, as in car 20, can lie in a horizontal plane, rather than having tapered risers, and can have straight, parallel sided vertical posts rather than tapered posts. Further, a straight through flat deck car need not have a top truss, and need not have a full height beam, but rather can have a reduced height beam as shown in rail car 320. An example of such a car, identified as 400, is shown in FIG. 1*d*. Similarly, a dropped deck center beam car can be constructed having a top truss, and having tapered posts, without departing from the principles of the present invention.

While it is preferred that center beam cars having straight-through decks corresponding to the level of the main sill top cap (typically about 41" above top of rail) have their reeling and storage apparatus adjacent to the side sill, it would also be possible to mount winding mechanisms, such as the fixed position cranks of car 320, between the posts of car 20, possibly mounted to a longitudinal stringer set at a height convenient for winding when standing on the deck, (that is to say, within 6 feet of deck level, and preferably within 4 feet of deck level, generally waist high or lower relative to an adult of average height) with storage boxes located between the posts in the manner of car 320. Further, while reeling and storage apparatus as shown are most advantageous for center beam cars, they can also be used for other types of flat car, or other types of bulkhead flat car.

It should also be noted that while, for example, boxes 108, 190, 424 to 430, and 460 have side sheets and peripheral wall portions formed from monolithic sheets, a storage enclosure need not have full sheets, but could have the form of a cage, or framework, of open bars. It is advantageous to use larger panels as this may tend to provide some protection to the coils of webbing from stones and other debris cast up during movement of the railcars.

It may also be noted that in each of the embodiments shown and described herein the storage box, or enclosure, is mounted in a position clear of the envelope in which the lading is carried. That is, whether the car has angled risers and tapered posts, or a flat deck and vertical posts with no taper, the storage enclosure lies clear of the bunks defined by the vertical lading bunk interface (such as the plane of the post flanges) and the horizontal, or lower lading bunk interface (be it defined by a flat continuous deck or by the upper surfaces of an array of risers). In some instances, as described and illustrated above, the storage enclosure may be mounted between the posts of the center beam structure, and in other cases the storage enclosure may be mounted in the deck structure adjacent to the side sills.

Various embodiments of the invention have now been described in detail. Since changes in and or additions to the above-described best mode may be made without departing from the nature, spirit or scope of the invention, the invention is not to be limited to those details, but only by the appended claims.

What is claimed is:

1. A center beam rail road car comprising:

a deck structure upon which lading can be supported, the deck structure being carried by spaced apart rail car trucks;

a central beam structure running along the deck structure and extending upwardly therefrom;

lading securement apparatus for restraining lading carried upon said deck structure; and lading securement storage apparatus mounted to said deck structure;

said lading securement apparatus including at least one band of webbing for wrapping about the lading, securing equipment mounted to at least one of (a) said deck structure and (b) said central beam structure, by which to anchor said band of webbing to at least one of (a) said deck structure and (b) said central beam structure, said lading securement storage apparatus including a winder mounted to said deck structure, said winder being operable to form said band into a storage configuration;

an enclosure mounted to said deck structure, said enclosure having a storage space defined therein for accommodating the band of webbing;

said deck structure being free of obstruction by said winder and said enclosure when lading is carried by said deck structure;

said car having lading bunk envelopes defined above said deck structure and to either side of said central beam structure;

said winder including a crank;

said enclosure having a pair of opposed walls having apertures formed therein to define a socket for receiving said crank in a position for winding said webbing;

said enclosure being pivotally mounted to said deck structure, and being movable to a stored position clear of said lading bunk envelopes.

2. A center beam rail road car comprising:

a deck structure upon which lading can be supported, the deck structure being carried by spaced apart rail car trucks;

a central beam structure running along the deck structure and extending upwardly therefrom;

lading securement apparatus for restraining lading carried upon said deck structure; and lading securement storage apparatus mounted to said deck structure;

said lading securement apparatus including at least one band of webbing for wrapping about the lading, securing equipment mounted to at least one of (a) said deck structure and (b) said central beam structure, by which to anchor said band of webbing to at least one of (a) said deck structure and (b) said central beam structure, said lading securement storage apparatus including a winder mounted to said deck structure, said winder being operable to form said band into a storage configuration;

an enclosure mounted to said deck structure, said enclosure having a storage space defined therein for accommodating the band of webbing;

said deck structure being free of obstruction by said winder and said enclosure when lading is carried by said deck structure;

said winder including a first member having a socket, and a removable crank member engageable with said socket; said first member being movably connected to said deck structure and being movable between a spooling position proud of said deck structure to an inoperative position shy of said deck structure.

3. A center beam rail road car comprising:

a deck structure upon which lading can be supported, the deck structure being carried by spaced apart rail car trucks;

a central beam structure running along the deck structure and extending upwardly therefrom;

said lading securement apparatus for restraining lading carried upon said deck structure; and lading securement storage apparatus mounted to said deck structure;

said lading securement apparatus including at least one band of webbing for wrapping about the lading, securing equipment mounted to at least one of (a) said deck structure and (b) said central beam structure, by which to anchor said band of webbing to at least one of (a) said deck structure and (b) said central beam structure, said lading securement storage apparatus including a winder mounted to said deck structure, said winder being operable to form said band into a storage configuration;

an enclosure mounted to said deck structure, said enclosure having a storage space defined therein for accommodating the band of webbing;

said deck structure being free of obstruction by said winder and said enclosure when lading is carried by said deck structure;

said winder including a first member having a socket, and a removable crank member engageable with said socket; said first member being pivotally attached to said deck structure and being movable between a spooling position proud of said deck structure and an inoperative position in which said deck structure is free of obstruction by said first member.

4. A center beam rail road car comprising:

a deck structure upon which lading can be supported, the deck structure being carried by spaced apart rail car trucks;

a central beam structure running along the deck structure and extending upwardly therefrom;

lading securement apparatus for restraining lading carried upon said deck structure; and lading securement storage apparatus mounted to said deck structure;

said lading securement apparatus including at least one band of webbing for wrapping about the lading, securing equipment mounted to at least one of (a) said deck structure and (b) said central beam structure, by which to anchor said band of webbing to at least one of (a) said deck structure and (b) said central beam structure, said lading securement storage apparatus including a winder mounted to said deck structure, said winder being operable to form said band into a storage configuration;

an enclosure mounted to said deck structure, said enclosure having a storage space defined therein for accommodating the band of webbing;

said deck structure being free of obstruction by said winder and said enclosure when lading is carried by said deck structure; and said winder including a first member having a socket, and a removable crank member engageable with said socket; said first member being movable to a retracted position lying within said enclosure.

5. A center beam rail road car comprising:

a deck structure upon which lading can be supported, the deck structure being carried by spaced apart rail car trucks;

a central beam structure running along the deck structure and extending upwardly therefrom;

lading securement apparatus for restraining lading carried upon said deck structure; and lading securement storage apparatus mounted to said deck structure;

said lading securement apparatus including at least one band of webbing for wrapping about the lading, securing equipment mounted to at least one of (a) said deck structure and (b) said central beam structure, by which to anchor said band of webbing to at least one of (a) said deck structure and (b) said central beam structure, said lading securement storage apparatus including a winder mounted to said deck structure, said winder being operable to form said band into a storage configuration;

an enclosure mounted to said deck structure, said enclosure having a storage space defined therein for accommodating the band of webbing;

said deck structure being free of obstruction by said winder and said enclosure when lading is carried by said deck structure;

said winder including a first member having a socket, and a removable crank member engageable with said socket;

in said operative position, said first member being located above said enclosure and said crank member being releasable from said socket once a reel is formed thereon, whereby a reel formed on said crank can fall into said enclosure when said crank is disengaged from said socket.

6. A center beam rail road car comprising:

a deck structure upon which lading can be supported, the deck structure being carried by spaced apart rail car trucks;

a central beam structure running along the deck structure and extending upwardly therefrom;

lading securement apparatus for restraining lading carried upon said deck structure; and lading securement storage apparatus mounted to said deck structure;

said lading securement apparatus including at least one band of webbing for wrapping about the lading, securing equipment mounted to at least one of (a) said deck structure and (b) said central beam structure, by which to anchor said band of webbing to at least one of (a) said deck structure and (b) said central beam structure, said lading securement storage apparatus including a winder mounted to said deck structure, said winder being operable to form said band into a storage configuration;

an enclosure mounted to said deck structure, said enclosure having a storage space defined therein for accommodating the band of webbing;

said deck structure being free of obstruction by said winder and said enclosure when lading is carried by said deck structure;

said winder including a first member having a socket, and a removable crank member engageable with said socket; said first member being rigidly fixed to said enclosure, and said enclosure being pivotally mounted to said deck structure.

7. The center beam rail road car of claim 6 wherein said enclosure has a lid, said deck structure defines a lower bunk interface above which lading can be carried, and in said inoperative position of said first member said lid lies one of (a) flush with said interface and (b) shy of said interface.

8. A center beam rail road car comprising;

a deck structure upon which lading can be supported, the deck structure being carried by spaced apart rail car trucks;

a central beam structure running along the deck structure and extending upwardly therefrom;

lading securement apparatus for restraining lading carried upon said deck structure; and lading securement storage apparatus mounted to said deck structure;

said lading securement apparatus including at least one band of webbing for wrapping about the lading, securing equipment mounted to at least one of (a) said deck structure and (b) said central beam structure, by which to anchor said band of webbing to at least one of (a) said deck structure and (b) said central beam structure, said lading securement storage apparatus including a winder mounted to said deck structure, said winder being operable to form said band into a storage configuration;

an enclosure mounted to said deck structure, said enclosure having a storage space defined therein for accommodating the band of webbing;

said deck structure being free of obstruction by said winder and said enclosure when lading is carried by said deck structure;

said winder including a crank and said enclosure having a socket in which to mount said crank for winding said webbing; and said enclosure being movably mounted to said deck structure.

9. A rail road car comprising:

a deck structure for supporting lading, said deck structure being supported on railcar trucks for rolling motion along railroad tracks;

lading securement apparatus connected to said deck structure, said lading securement apparatus including at least one web band for wrapping about the lading and at least one tightening mechanism operable to draw the band tight about the lading to restrain the lading relative to the deck structure;

a lading securement storage apparatus mounted to the deck structure, said lading securement storage apparatus including an enclosure mounted to said deck structure, said enclosure having an opening defined therein for admitting said web band to be placed within said enclosure;

said enclosure being movable to a first position in which said opening is exposed to permit said web band to be introduced therein; and said enclosure being movable to a second position in which said opening is obstructed.

10. The rail road car of claim 9 wherein said enclosure is mounted at a hinge, and is pivotable about said hinge between said first and second positions.

11. The rail road car of claim 9 wherein said enclosure includes a socket, and said lading securement storage apparatus includes a crank mountable within said socket for coiling said web band.

12. The rail road car of claim 9 wherein said storage apparatus includes a winding apparatus mountable therewith, said winding apparatus being operable to coil said web band.

13. The rail road car of claim 12 wherein said winding apparatus includes a crank.

14. The winding apparatus of claim 13 wherein said crank includes a radial slot through which said web band can be threaded.

15. A center beam rail road car comprising:

a deck structure carried upon spaced apart rail car trucks;

a central beam assembly running along said deck structure and standing upwardly thereof, bunks for carrying lading being defined to either side of said central beam structure above said deck structure;

said central beam structure having an array of posts standing upwardly of said deck structure;

lading securement apparatus for securing lading in said bunks, said lading securement apparatus including web bands for wrapping about the lading;

a winder mechanism mounted between a pair of said posts for reeling said bands; and a storage enclosure for accommodating wound web bands, said storage enclosure being mounted between a pair of said posts.

16. The center beam rail road car of claim 15 wherein said winder includes a crank having a shaft about which to wind the web bands, said shaft having an axis oriented longitudinally relative to said rail road car.

17. The center beam rail road car of claim 15 wherein said storage enclosure has a movable lid controlling access thereto, and said movable lid has a fitting by which said lid is capable of being secured in place with a lock.

18. A strap storage apparatus for a rail road car, said strap storage apparatus comprising:

a storage enclosure for receiving a strap to be stored, said storage enclosure being mountable to a rail road car;

a winding mechanism mounted to the storage enclosure;

said winding mechanism being movable between a first position and a second position;

in said first position said winding mechanism being inoperable; and in said second position said winding mechanism being operable to form the strap into a reel for placement in said storage enclosure.

19. The strap storage apparatus of claim 18 wherein in said first position said winding mechanism is stored within said storage enclosure.

20. The strap storage apparatus of claim 18 further comprising a retainer for holding said winding mechanism in said second position.

21. The strap storage apparatus of claim 18 wherein said winding mechanism is pivotally movable relative to said storage enclosure.

22. The strap storage apparatus of claim 18 wherein said winding mechanism includes a crank.

23. The strap storage apparatus of claim 18 wherein said winding mechanism includes a slotted shaft for admitting a web, and a crank handle connected to said shaft.

24. The strap storage apparatus of claim 18 wherein said storage enclosure is capable of holding more than one strap.

25. The strap storage apparatus of claim 18 wherein said storage enclosure has a drainage aperture.

26. The strap storage apparatus of claim 18 wherein said winding mechanism includes a member pivotally connected to said storage enclosure, and, in said first position, said member forms a panel of said storage enclosure.

27. The strap storage apparatus of claim 18 wherein said storage enclosure has a hinged panel and said winding mechanism is mounted to said hinged panel.

28. The strap storage apparatus of claim 27 wherein said hinged panel acts as a movable closure member for said storage enclosure.

29. The strap storage apparatus of claim 18 wherein said storage enclosure includes a hinged panel, said hinged panel being movable to an open position to permit straps to be placed within said storage enclosure.

30. The strap storage apparatus of claim 29 wherein said hinged panel has a first side that faces inwardly relative to said enclosure when said hinged panel is in a closed position relative to said enclosure, and said winding mechanism extends away from said first side of said panel.

31. The strap storage apparatus of claim 30 wherein said winding mechanism includes a pair of spaced-apart plates having bores defined therein for accommodating a shaft, a shaft mounted therethrough, and a crank operable to turn said shaft.

32. The strap storage apparatus of claim 31 wherein said shaft has a slot defined therein for admitting a portion of a strap.

33. A strap storage apparatus for a rail road car, said strap storage apparatus comprising:

a storage enclosure for receiving a strap to be stored;

a winding mechanism, said winding mechanism being operable to form the strap into a reel for placement in said storage enclosure;

said storage enclosure and said winding mechanism being mountable to the rail road car.

34. The strap storage apparatus of claim 33 wherein said winding mechanism includes a crank.

35. The strap storage apparatus of claim 33 wherein said winding mechanism includes a slotted shaft for admitting a web, and a crank connected to said shaft.

36. The strap storage apparatus of claim 33 wherein said storage enclosure is capable of holding more than one strap.

37. The strap storage apparatus of claim 33 wherein said storage enclosure has a drainage aperture.

38. The strap storage apparatus of claim 33 wherein said winding mechanism includes a member pivotally connected to said storage enclosure, and, in said storage position, said member forms a panel of said storage enclosure.

39. The strap storage apparatus of claim 33 wherein said storage enclosure has a hinged panel and said winding mechanism is mounted to said hinged panel.

40. The strap storage apparatus of claim 39 wherein said hinged panel acts as a movable closure member for said storage enclosure.

41. The strap storage apparatus of claim 33 wherein said storage enclosure includes a hinged panel, said hinged panel being movable to an open position to permit straps to be placed within said storage enclosure.

42. The strap storage apparatus of claim 41 wherein said hinged panel has a first side that faces inwardly relative to said storage enclosure when said hinged panel is in a closed position relative to said storage enclosure, and said winding mechanism extends away from said first side of said hinged panel and is operable when said hinged panel is moved to a second, open position.

43. The strap storage apparatus of claim 33 wherein said winding mechanism includes a pair of spaced apart plates having bores defined therein for accommodating a shaft, a shaft mounted therethrough, and a crank operable to turn said shaft.

44. The strap storage apparatus of claim 43 wherein said shaft has a slot defined therein for admitting a portion of a strap.

45. The strap storage apparatus of claim 33 wherein said winding mechanism is movable to a storage position within said storage enclosure.

46. The strap storage apparatus of claim 45 further comprising a retainer for holding said winding mechanism in an operating position.

47. The strap storage apparatus of claim 45, wherein said winding mechanism is pivotally movable relative to said storage enclosure.

48. A center beam rail road car comprising;

a rail road car body carried by rail road car trucks for rolling motion along railroad car tracks;

said body having a deck for carrying lading and a central beam structure standing upwardly of said deck and running lengthwise relative thereto;

at least one strap operable to secure lading to said deck, and a winding mechanism mounted to said rail road car body, said winding mechanism being operable to form said strap into a reel when said strap is not in use; and said winding mechanism being operable to permit release of said strap therefrom as reeled;

said center beam rail road car further including a storage enclosure mounted to said rail road car body for receiving said strap when reeled;

said enclosure having niches for more than one reel.

49. A center beam rail road car comprising:

a rail road car body carried by rail road car trucks for rolling motion along railroad car tracks;

said body having a deck for carrying lading and a central beam structure standing upwardly of said deck and running lengthwise relative thereto;

at least one strap operable to secure lading to said deck;

a plurality of winding mechanisms mounted to said central beam structure; said winding mechanisms being operable to form said strap into a reel when said strap is not in use; and said winding mechanisms being operable to permit release of said strap therefrom as reeled.

* * * * *